US006561317B1

(12) United States Patent
Dudley

(10) Patent No.: US 6,561,317 B1
(45) Date of Patent: May 13, 2003

(54) FOODSERVICE SYSTEM

(75) Inventor: William R. Dudley, Lawrenceville, GA (US)

(73) Assignee: Duke Manufacturing Company, St. Louis, MO (US)

( * ) Notice: Subject to any disclaimer, the term of this patent is extended or adjusted under 35 U.S.C. 154(b) by 287 days.

(21) Appl. No.: 09/672,677

(22) Filed: Sep. 28, 2000

(51) Int. Cl.[7] ..... E04H 3/04
(52) U.S. Cl. ..... 186/38; 312/198
(58) Field of Search ..... 186/38, 45; 248/519, 248/345, 539, 72; 99/340, 443 R, 449, 483; 222/146.1, 160, 519; 312/116, 137, 140.2, 198, 201, 202, 203

(56) References Cited

U.S. PATENT DOCUMENTS 1,624,267 A * 4/1927 Lyndon et al.
1,677,764 A * 7/1928 Gloekler
2,894,604 A * 7/1959 McMillan
2,900,045 A * 8/1959 Conklin et al.
3,170,541 A 2/1965 Werner
3,874,479 A 4/1975 Onori et al.
4,692,847 A * 9/1987 Gandy
D302,221 S * 7/1989 Suttles et al.
D326,024 S * 5/1992 Boyd et al.
5,163,536 A * 11/1992 Tuhro et al.
5,317,977 A * 6/1994 Omessi
5,413,135 A 5/1995 Poole
5,618,089 A * 4/1997 Stenemann
5,944,143 A * 8/1999 Papas et al.

FOREIGN PATENT DOCUMENTS

FR 2587605 A1 * 3/1987 ..... A47F/10/06
JP 5-285018 A * 11/1993 ..... A47B/77/06

* cited by examiner

*Primary Examiner*—Donald P. Walsh
*Assistant Examiner*—Mark J. Beauchaine
(74) *Attorney, Agent, or Firm*—Richard G. Heywood

(57) ABSTRACT

The invention is embodied in a commercial foodservice system having a primary counter unit constructed and arranged to perform a direct or related foodservice function, and an independent peripheral unit constructed and arranged in juxtaposition with the counter unit to perform a non-foodservice function. The foodservice system encompasses arrangements of multiple counter units disposed in-line and/or at selective angularity, and intermediate free-standing pylon peripheral units and bridging canopy peripheral units.

34 Claims, 26 Drawing Sheets

FOODSERVICE SYSTEM

FIELD OF THE INVENTION

This invention relates generally to commercial foodservice systems, and particularly to single and multiple counter units for the preparation of prepared foods as in cafeteria and buffet lines.

BACKGROUND OF THE INVENTION

Foodservice equipment is used in commercial kitchens for food preparation in volume-feeding facilities, such as restaurants, hotels, institutions, corporate dining rooms and the like, and in the presentation and service of prepared foods especially in cafeteria and buffet lines, retail food courts and the like.

Such commercial foodservice equipment is traditionally custom designed for various specific foodservice functions and each type of counter unit is usually self-contained and free standing. Thus, each counter unit is designed with a, countertop built onto a supporting base selected to be compatible with the foodservice function of the top panel. The countertop function dictates to the foodservice provider the types of surface and base configurations as well as utility requirements and other desirable features. In addition, all counters used in preparing or serving food products conform to the rigid sanitation codes of the National Sanitation Foundation (NSF), and thus traditionally heavy gauge stainless steel has been deemed necessary, making the unit cost of commercial equipment relatively expensive.

In prior art foodservice systems, as used in cafeteria line-ups for instance, a series of different function counters are typically connected together in a continuous rigid line-up. Tuhro U.S. Pat. No. 5,163,536 discloses a rigidly interconnected series of cafeteria counters and the like typical of the past equipment styling direction where the foodservice function is the major concern. Thus, apart from achieving the necessary functional and safety requirements for such commercial equipment, the installation location and maintenance of past foodservice counter units is generally limited to a single style or arrangement of counters as dictated by service function, and peripheral decor display and merchandising function has been minimal and unsatisfactory. In short, past commercial foodservice counters have been custom made and expensive, the selectivity of counter unit arrangements has been limited, the manufacturing and delivery time has been long, and assembly of equipment line-ups has been awkward and time consuming, and the resulting systems show no real style or uniqueness.

SUMMARY OF THE INVENTION

The invention is embodied in a commercial foodservice system having a primary counter unit constructed and arranged to perform a direct or related foodservice function, and an independent peripheral unit constructed and arranged to perform a non-foodservice function. The peripheral unit may be a separate floor-supported pylon means in adjacent lateral disposition from the counter unit, and/or canopy means disposed above the counter unit.

A principal object of the present invention is to provide a counter unit and enhanced peripheral display decor for commercial foodservice systems affording great design flexibility and upscale decor selectivity.

Another object is to provide a foodservice system with selective angular placement of main level countertop units with flanking pylon or shelving peripherals and selectivity of an upper level canopy peripheral.

Another object is to provide a commercial counter unit that is rugged in construction and economically manufactured, and which permits easy installation in selective floor arrangements with revision capability without requiring special adapting connectors.

Still another object is to provide novel foodservice equipment offering improved flexibility in decor and product display, with superior accessibility for maintenance.

These and still other objects and advantages will become more apparent hereinafter.

BRIEF DESCRIPTION OF THE DRAWINGS

In the accompanying drawings, which form a part of the specification and wherein like numerals refer to like parts wherever they occur.

DESCRIPTION OF THE PREFERRED EMBODIMENTS

Figure 1:
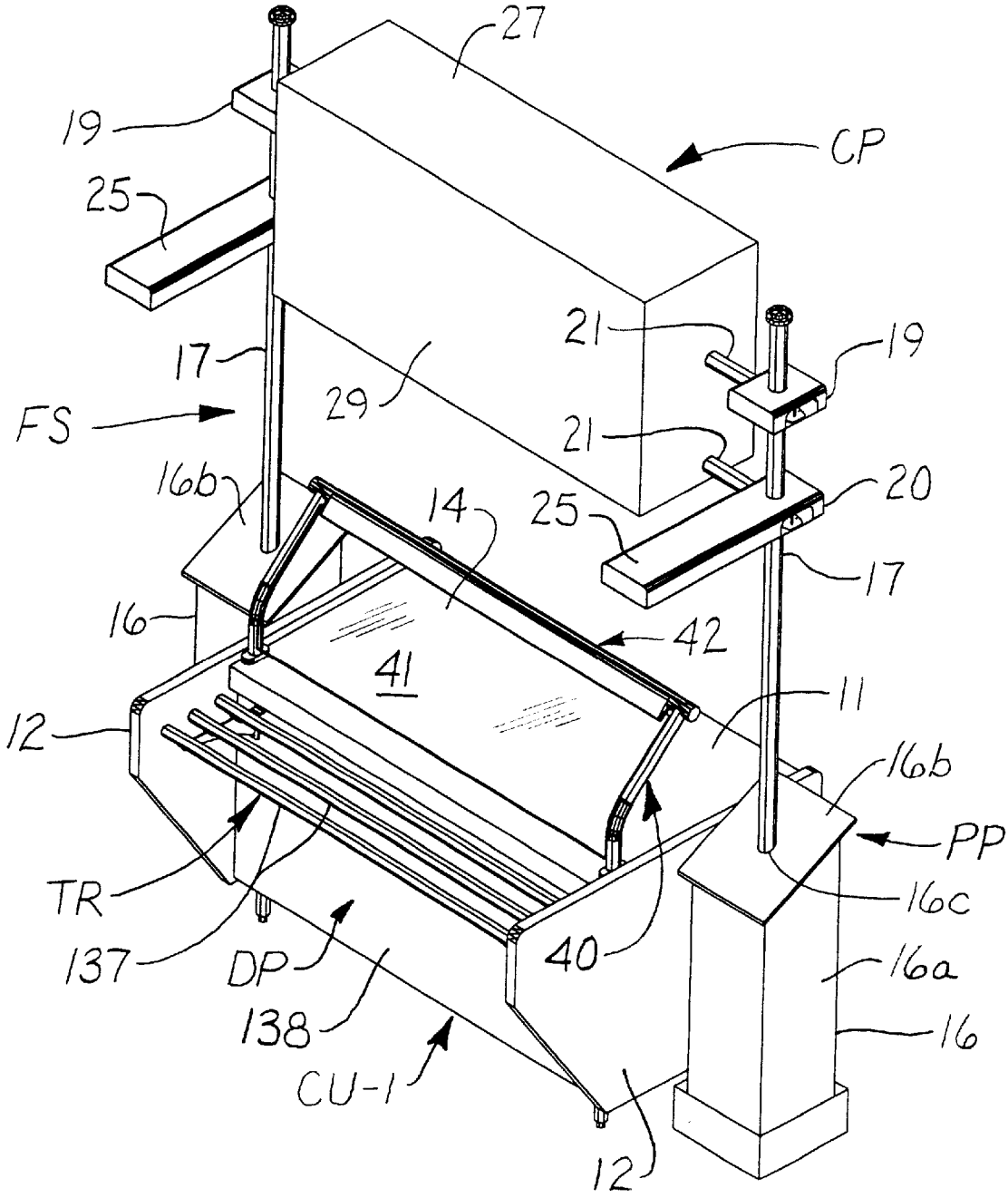
FIG. 1 is an enlarged front elevational view of a single primary foodservice unit embodying one aspect of the foodservice system invention.
Figure 4:
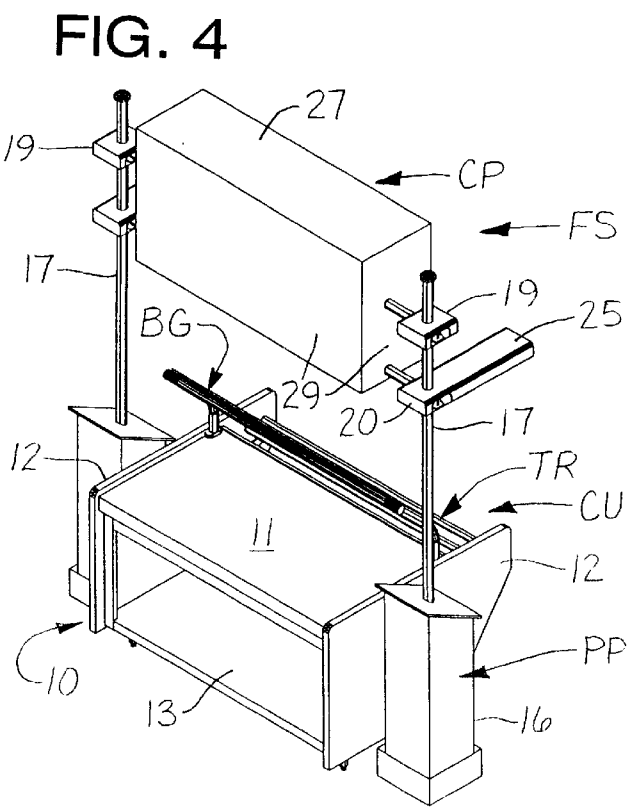
FIG. 4 is a rear elevational view thereof.
Figure 3:
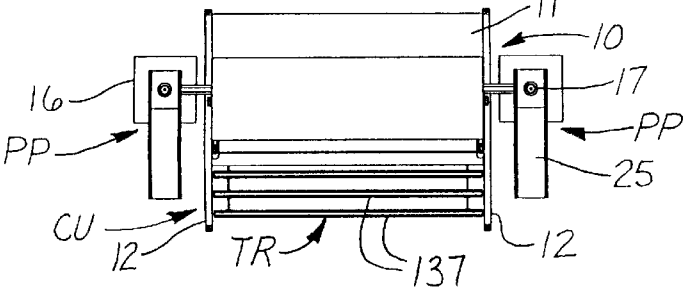
FIG. 3 is a plan view thereof.
Figure 2:
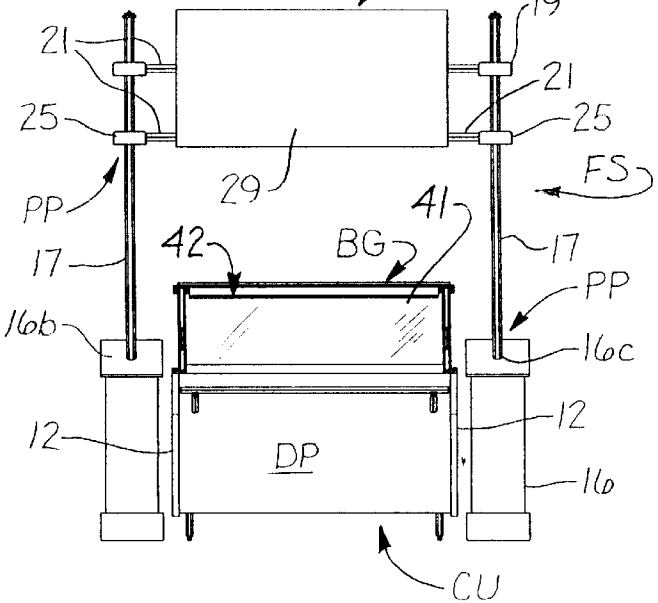
FIG. 2 is a front elevational view of the FIG. 1 embodiment.

The foodservice system of the present invention utilizes typical service counter units CU for the performance of customary direct and related foodservice functions, and incorporates novel peripheral units (PP, CP, SP) to perform non-foodservice functions as well as including improvements in food delivery and health safety features (TR, BG) to be described.

The following descriptions are adopted herein for purposes of disclosing and claiming the invention:

"direct foodservice function" means the generic usle of a primary service counter unit CU for heated, cooled or ambient food product work stations. Such counter units CU are inclusive of steam tables and hot food drop-in units and soup wells; hot food surface and microwave units; bun, pretzel, nacho chip and cheese warmers; cold pan and frost top units; deli products, refrigerated and ambient selector cases; salad bar units; hot and cold juice and beverage units, coffee brewers and shuttles; ice and soda dispensers; dessert units and like cafeteria, food court and speciality food units.

"related foodservice function" means the general use of a primary counter unit for display or dispensing of ancillary food consumption articles or accouterments such as trays, tableware, napkins, condiments, cups and dishes, or the performance of cashier services or the like.

"peripheral(s)" means a secondary unit or subsystem associated with a primary counter unit for providing decor enhancement, lighting, advertising display or information signage. Peripherals of the present invention include free-standing pylon units, canopy units and transitional; shelving.

"non-foodservice function" generically means the performance by a peripheral of a function that is ancillary to the direct or related foodservice functions of the primary counter unit.

"pylon peripheral" refers generally to an independent, free-standing vertical unit independent of and laterally disposed from a primary counter unit.

"canopy peripheral" refers generally to an independent unit in vertically superjacent position above a primary. counter unit. The canopy may also be called a "soffit" or "marquee".

"transitional shelving peripheral" generally refers to an ancillary shelving system adapted to be positioned between adjacent primary counter units, and sometimes being connected thereto in a fixed or adjustable horizontal position.

FIGS. 1–4 show that one aspect of the invention is embodied in a foodservice system FS having single service counter unit CU framed by a peripheral decor system comprised of two laterally spaced, flanking pylon peripherals PP spanned by a canopy peripheral CP vertically disposed over the counter unit CU. The counter unit CU-1 of this embodiment has a typical cabinet 10 structured with an upper solid top counter surface 11, opposed outer end walls 12, a front decor panel DP and a rearwardly opening under-counter area 13. The counter unit CU-1 also has a tray rail TR defining a front service area in front of the countertop 11, and is shown with a breath guard BG which forms a transparent protective shield extending upwardly at the front of the cabinet and countertop 11 so as to separate the food dispensing area from the consumer. A solid countertop surface 11 may be used for several food purposes, such as a pastry selection station, and the breath guard BG of the invention is shown with the glass curtain 14 in a downward, closed position as when a server is dispensing the food products. As will appear, the breath guard is adjustable to upper open positions as for self service or to facilitate cleaning and maintenance. Features of the tray rail TR will also be described more fully hereinafter.

Figure 11:
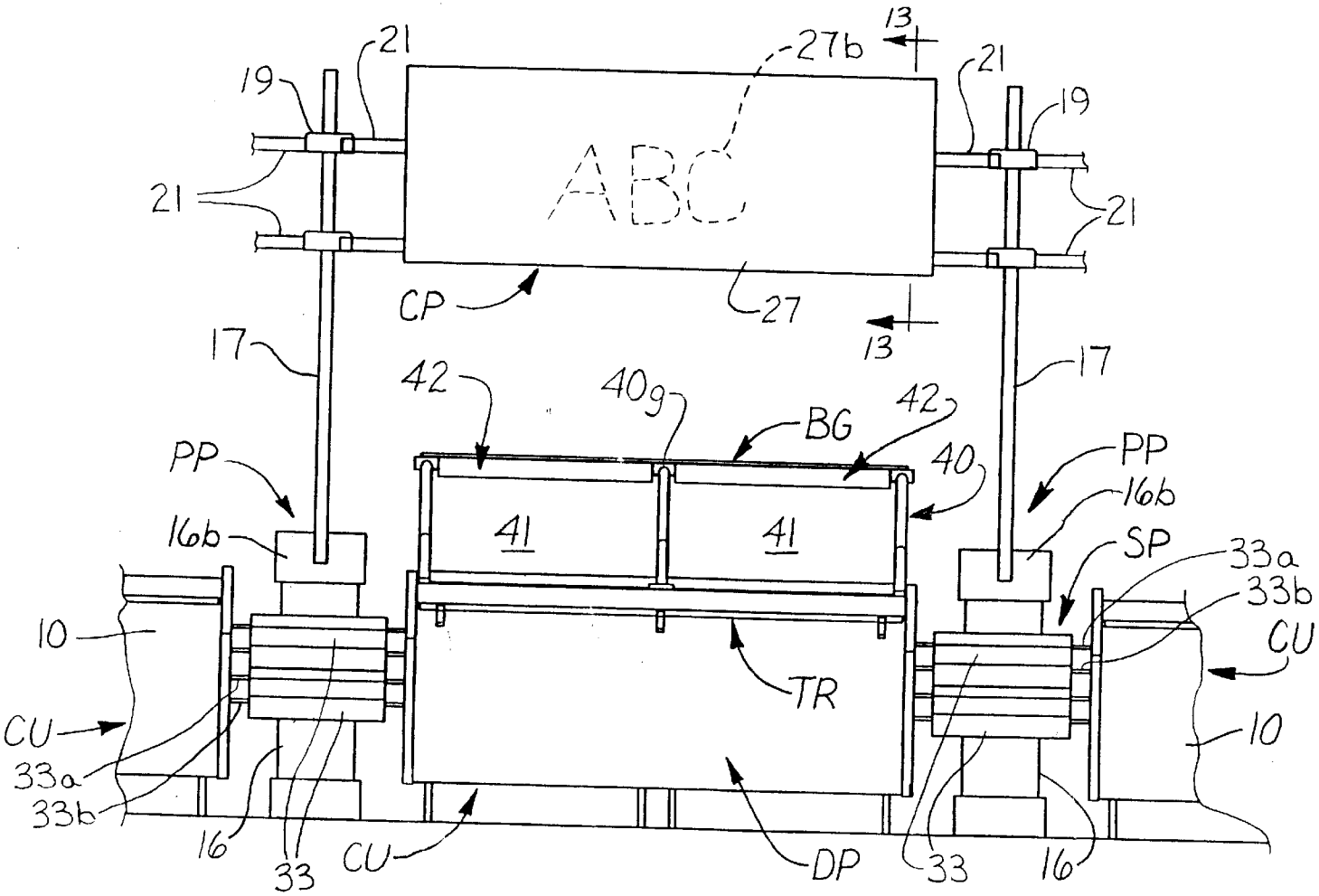
FIG. 11 is an enlarged front elevational view, partly fragmentary, illustrating one relationship of single counter units in a multiple system line-up.
Figure 12:
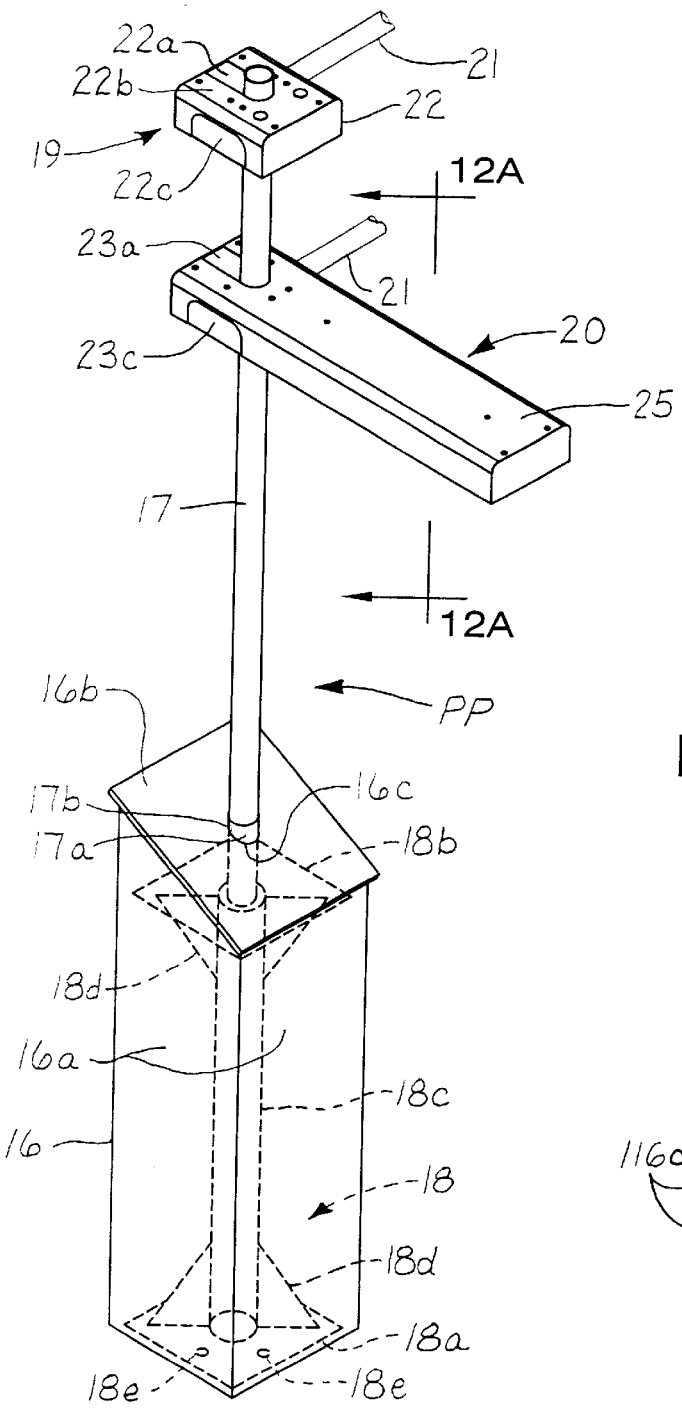
FIG. 12 is an enlarged perspective view of a typical pylon peripheral of the invention.

Still referring to FIGS. 1–4 and 11 and 12, the pylon peripherals PP of the decor system each includes a base section 16 which supports a vertically extending stanchion member or pole 17. The base section 16 is free standing independently of the counter unit CU and in adjacent juxtaposition to one end wall 12 there, and has side walls 16*a* and a sloping top wall 16*b*, although other base section configurations such as cylindrical, frusto-cylindrical, triangular are within the scope of the invention. FIG. 12 shows that the base section 16 is built on a solid heavy inner mounting core or frame (FIG. 12), preferably metal. Thus, the frame 18 includes a lower base plate 18*a* and upper alignment plate 18*b* connected by a vertical sleeve 18*c* to receive and support the vertical stanchion 17. The plates 18*a* and 18*b* may be rigidly connected to the sleeve 18*c* by triangular braces 18*d*, and the inner mounting frame may be anchored to the floor by bolts 18*e* or the like. The stanchion 17 is mounted in the sleeve 18*c* and extends through a hole 16*c* in the base section top wall 16*b*. The stanchion 17 is vertically adjustably supported in the base mounting frame sleeve 18*c* as by a collar 17*a* slidable on the pole and secured at the selected vertical height by a set screw 17*b*. The upper end section of the stanchion 17 is constructed and arranged for two functions; namely, to provide a means 19 for supporting the canopy peripheral CP above the counter unit CU, and to provide an additional decor mounting means 20, as for a flag, gonfalon, banner, sign or the like.

The canopy mounting means 19 comprises upper and lower mounting assemblies (FIGS. 12–12C) that each have a stanchion plate or mounting bracket 19*a* secured to the pole 17 and having a pair of vertical pins 19*b* on opposite sides of the pole 17 for swingably mounting one end 21*a* of a horizontally extending canopy support rod or bar 21, to be described. The canopy mounting means 19 of the upper assembly includes a cover member 22 for housing the upper support arm 21. As shown best in FIGS. 12C and 12D, the cover member 22 forms a box with an open bottom and one end, and having a slot 22*a* in the top wall 22*b* and elongate slots 22*c* in opposed side walls 22*d*. The cover member or housing 22 sits over the upper plate 19*a* and is attached thereto to thereby encase the pivot ends 21*a* and retain the support arms 21 in place. End caps 22*e* close the open end (and the side wall slot 22*c*, if not used). The canopy mounting means of the lower assembly is similar to the upper assembly, but is formed on the end of the decor mounting arm 20. Thus, an end cap or cover section 23 of the decor arm forms a box with an open bottom and one end to be placed around the pole 17 and be secured to the lower flange plate 19*a* of the lower assembly. A slot 23*a* is formed in the upper wall 23*b* to receive the pole 17, and elongated slots 23*c* are formed in opposed side walls 23*d* to accommodate the lower support arm 21. Cover plate 23*e* closes the ends and an unused side wall opening 23*c*, if any. As will be described in greater detail, the elongate slots 22*c* and 23*c* permit relative angular positioning of the canopy support bars 21.

Figure 12D:
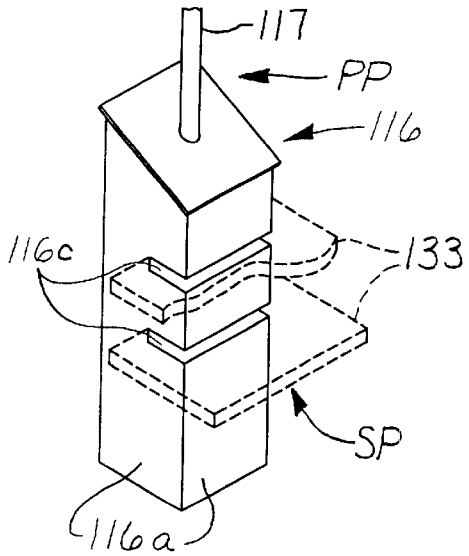
FIG. 12D is a fragmentary perspective view of the pylon peripheral of FIG. 12, showing in phantom a modification accommodating transitional shelving of the invention.
Figure 12A:
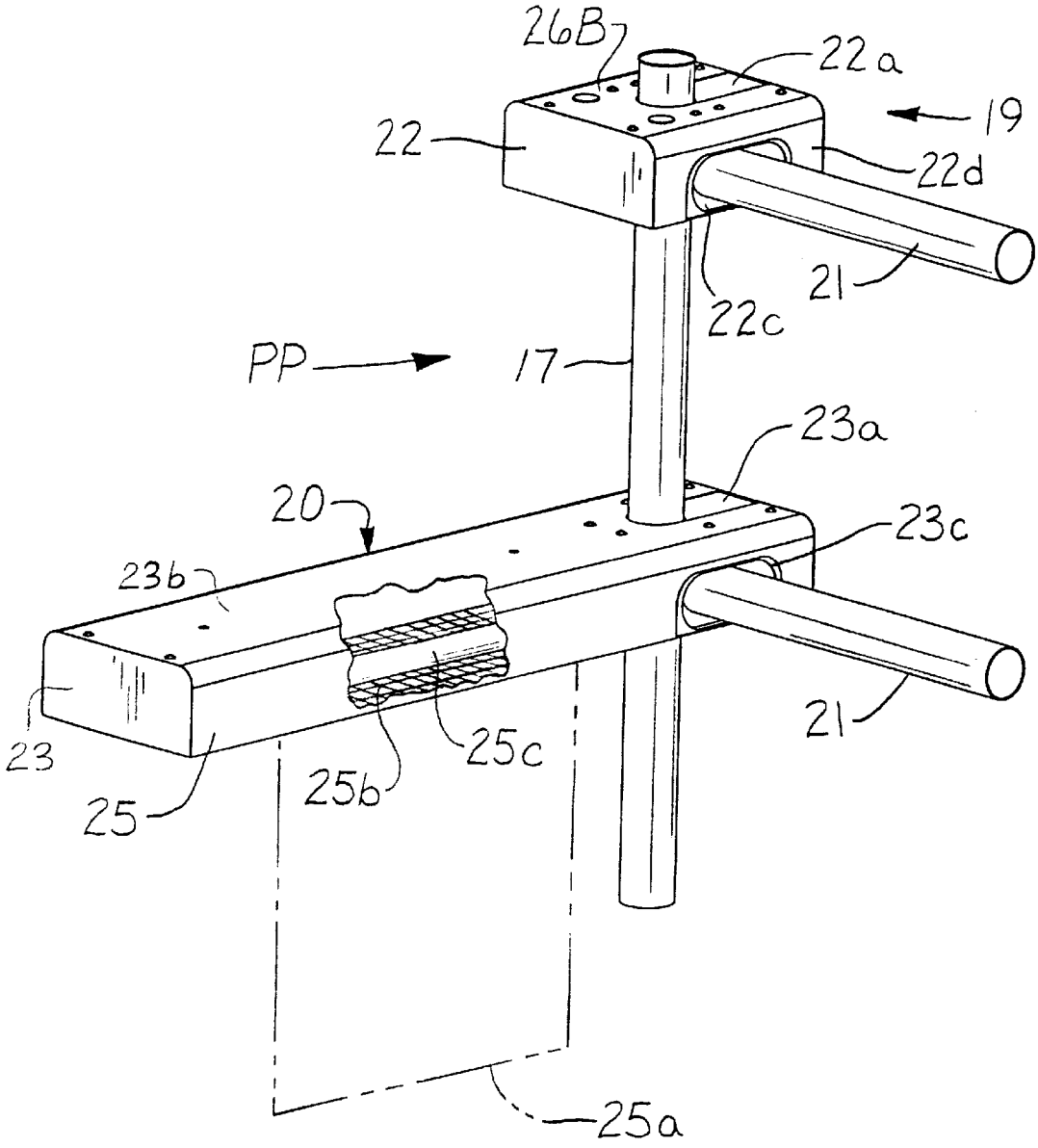
FIG. 12A is a perspective view of the upper hinging section of the pylon peripheral for supporting a canopy peripheral of the invention, as taken substantially along, line 12A—12A of FIG. 12.
Figure 12B:
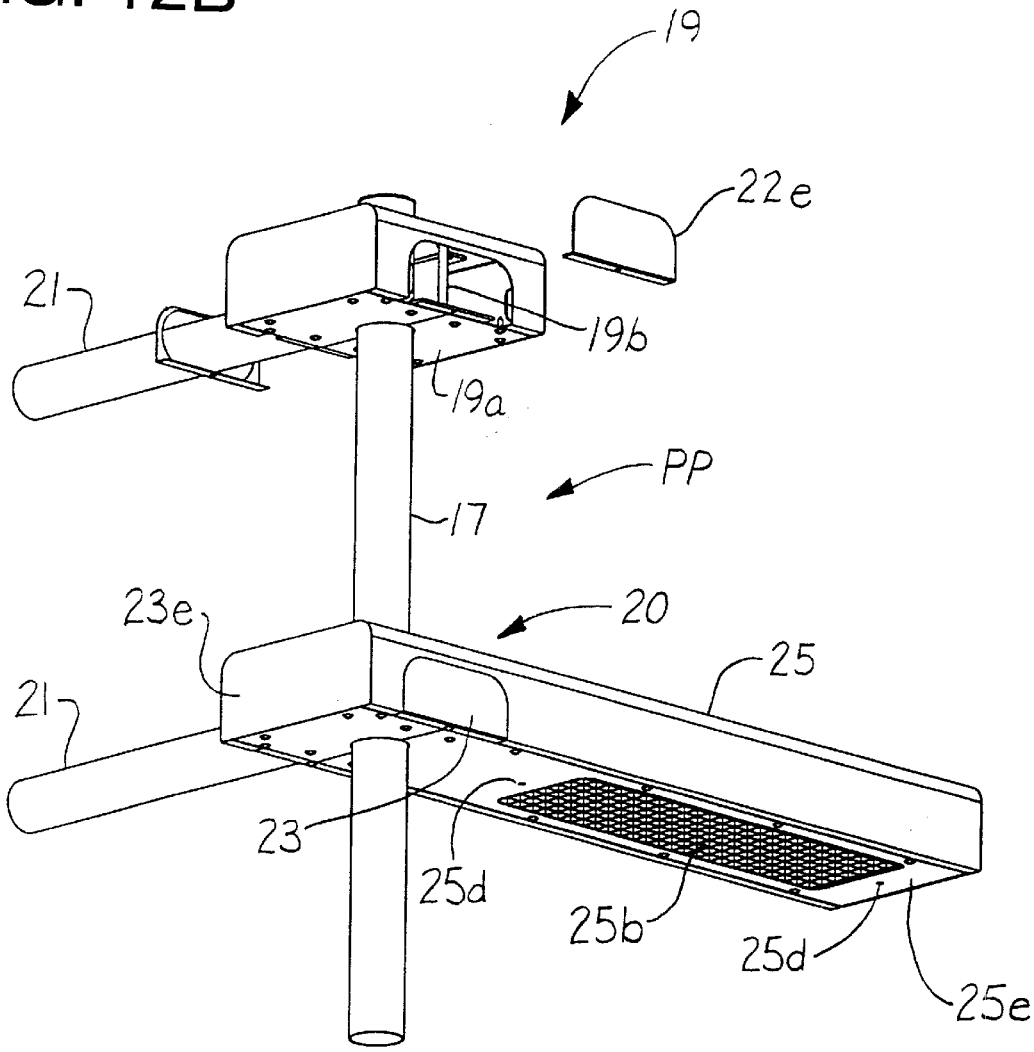
FIG. 12B is a perspective view of the upper hinging section of FIG. 12A, but taken from a different angle and looking upward to show the display light diffuser.
Figure 12C:
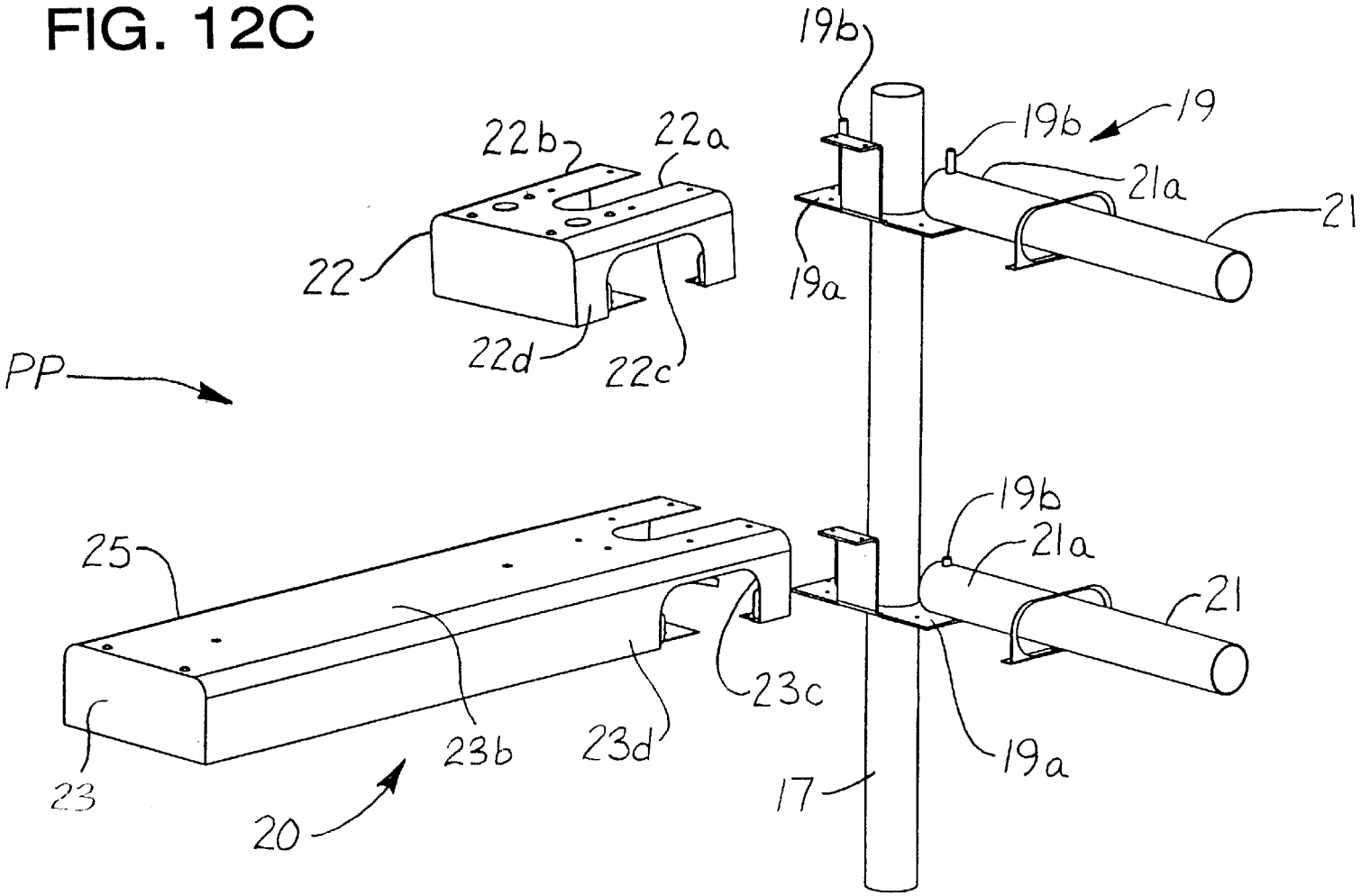
FIG. 12C is a partially exploded view of the upper hinging section of the pylon peripheral.

The decor arm 20 is formed as an extension of the lower mounting assembly, this arm 20 being constructed and arranged to form a horizontal standard or cross piece frame 25 to suspend a gonfalon 25*a* or other decorative banner or sign device, as from mounting holes 25*d*. As shown in FIGS. 12A and 12B, the frame 25 may house lighting means 25*c* for downward illumination through a light diffuser 25*b* in the bottom wall 25*e*. The lamps 25*c* are arranged lengthwise of the decor arm 20 and spaced apart along the outer sides of the arm to provide maximum downward lighting on both sides of the gonfalon device 25*a*. Electric for the display arm lamps 25C, as well as for the canopy peripheral now to be described, may be brought up internally through the vertical support sleeve 18*c* from the floor in a conventional manner. FIG. 12D of the drawings illustrates a modified pylon base section 116 constructed and arranged to accommodate one form of a transitional shelving peripheral SP in which the side walls 116*a* are slotted, at 116*c* to receive and hold a pair of vertically spaced shelves 133, as shown in phantom and to be described.

Figure 13:
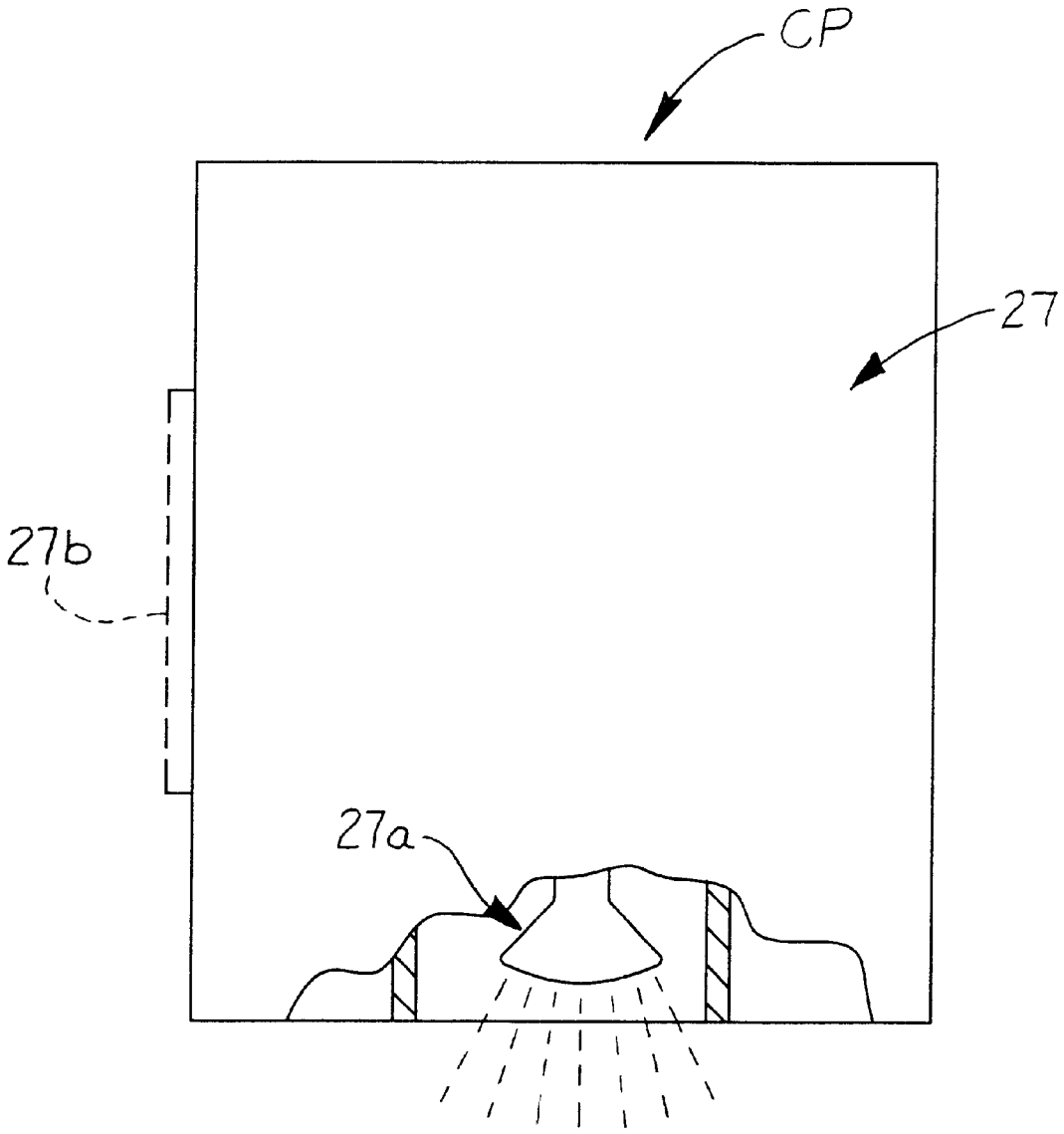
FIG. 13 is an end elevational view of a typical canopy peripheral of the invention, taken substantially along line 13—13 of FIG. 11 and partly broken away to show recessed lighting for an associated service counter unit.
Figure 13A:
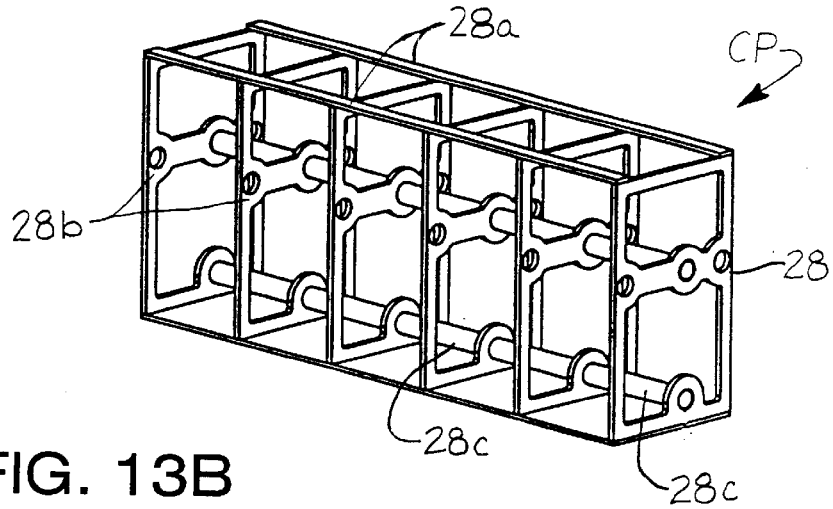
FIGS. 13A, 13B and 13C are perspective views of a typical canopy peripheral as shown during assembly, and illustrating a phantom line connection to an adjoining pylon peripheral.
Figure 13B:
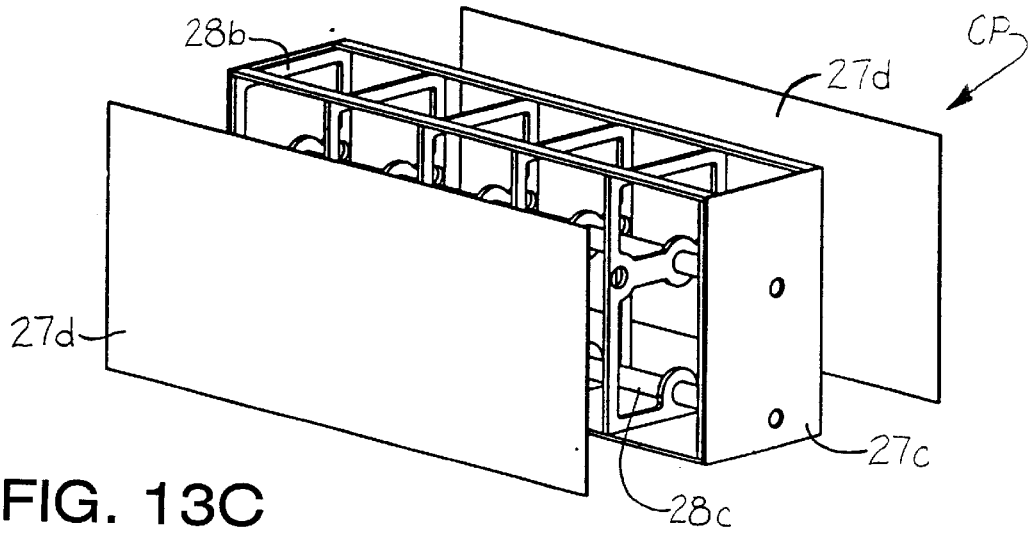
Figure 13C:
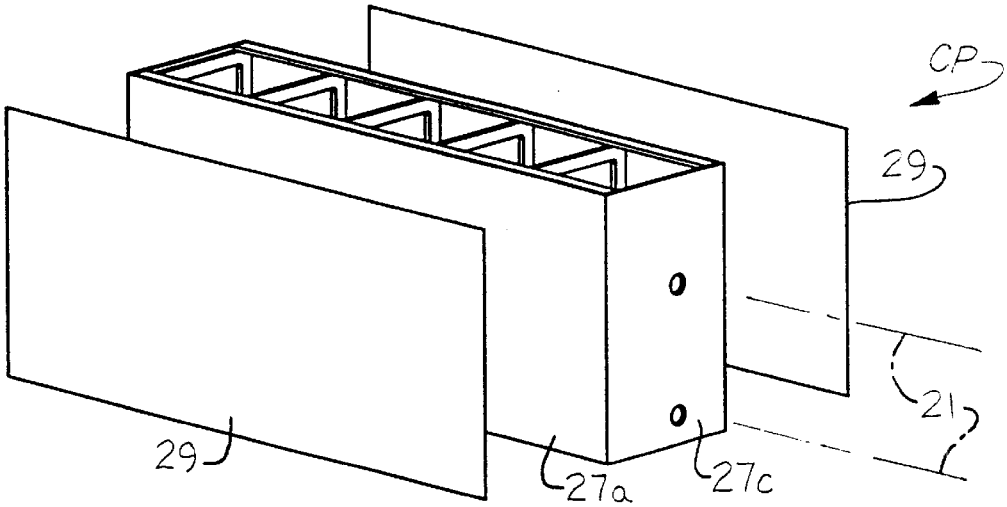

Referring now particularly to FIGS. 11 and 13–13*c*, the canopy peripheral CP is constructed and arranged to overhang the counter unit CU and bridge across the pylon peripherals PP to "picture frame" the counter unit and provide a non-foodservice function of esthetically enhancing its appearance and presentation of foods. Basically, the canopy peripheral CP is a box-type enclosure 27 which accommodates overhead lighting 27*a* and/or signage 27*b* (FIGS. 1 and 13) of any kind as well as providing a high style decor presentation. FIGS. 13A–13C show that the canopy is constructed with an interior frame 28 having longitudinal struts 28*a* interconnecting a series of spaced ribs 28*b*. Upper and lower longitudinal tubes 28*c*, such as PVC, extend between the ends 27*c* to slidably receive the support rods 21 (shown in phantom in FIG. 13*c*) which connected to the upper and lower brackets 19 and 20 of the pylon peripheral PP. An end panel 27*c*, and side panels 27*d* structurally enclose the canopy peripheral CP, and similar panels (not shown) are provided for the top and bottom. An outer decor panel or skin 29 may be applied or laminated over the inner panels 27*c* and *d*, etc. It will be apparent that the support arms 21 are assembled within the canopy tubes 28*c*, and then positioned at their outer ends 21*a* to engage the mounting pins on the pylon members to thereby suspend the canopy CP between the pylons PP.

Figure 5:
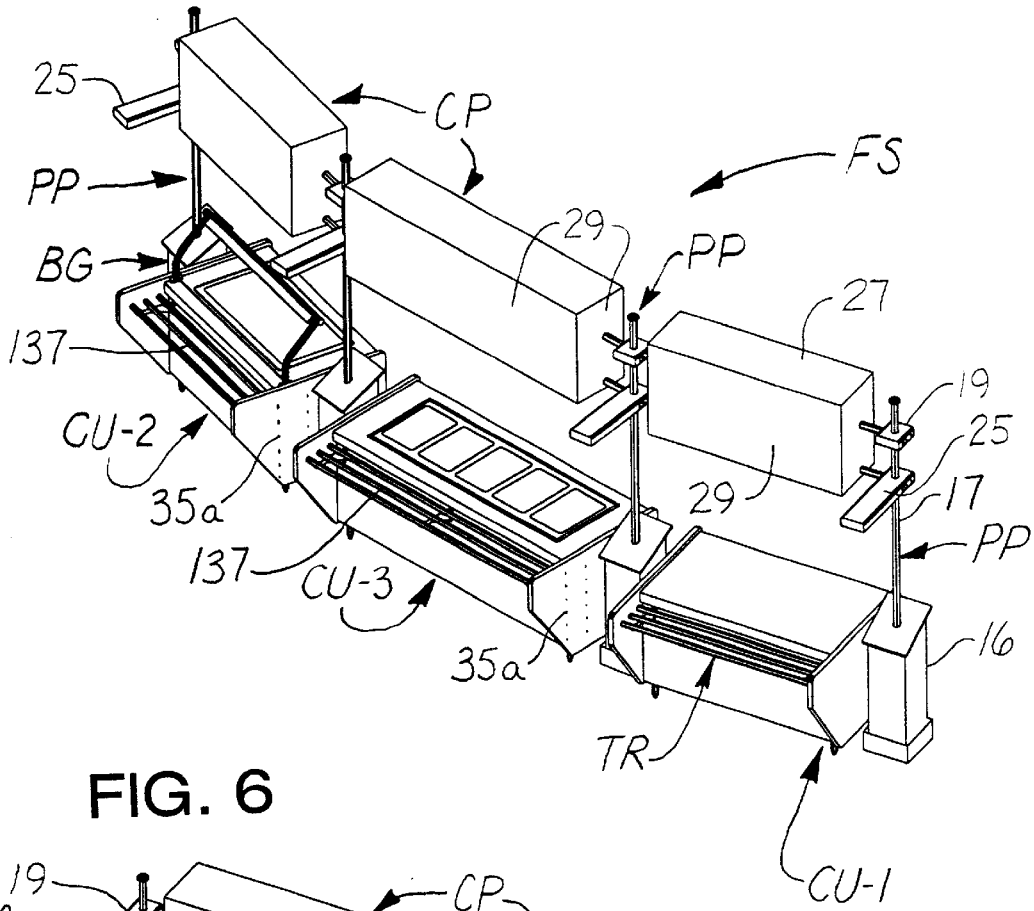
FIG. 5 is a front perspective view illustrating another aspect of the foodservice system utilizing multiple primary counter units and the peripheral non-foodservice units therefor.
Figure 6:
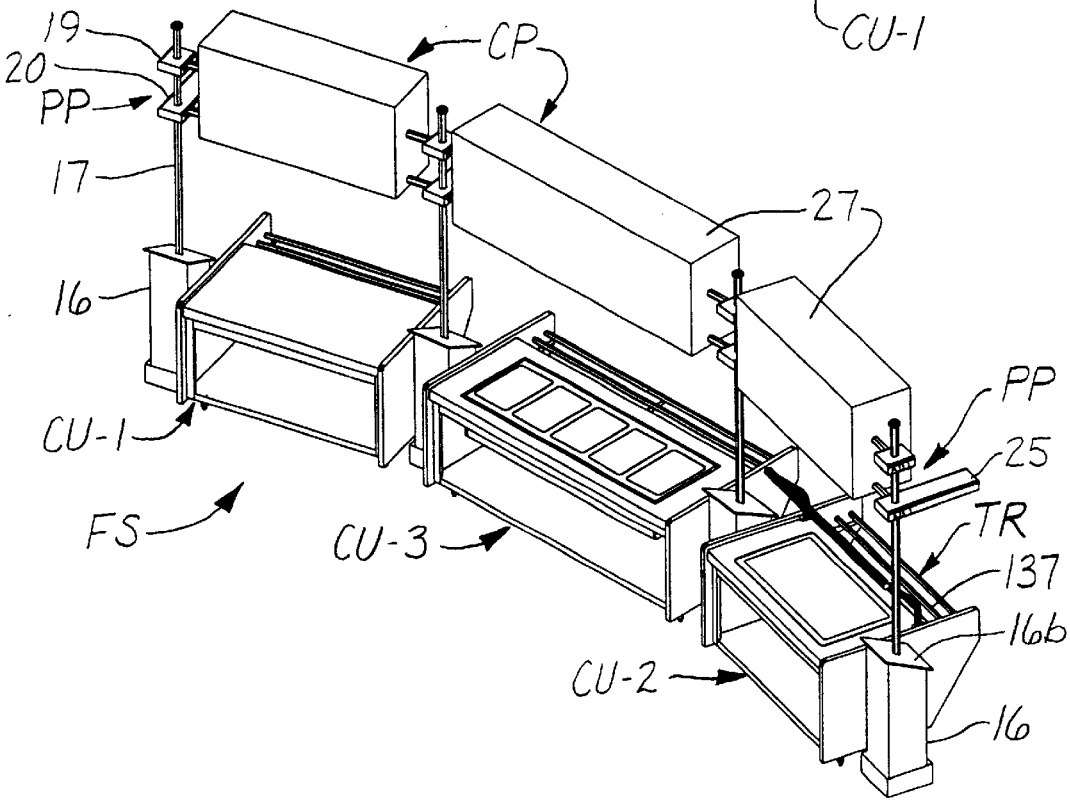
FIG. 6 is a rear perspective view of the FIG. 5 embodiment.
Figure 7:
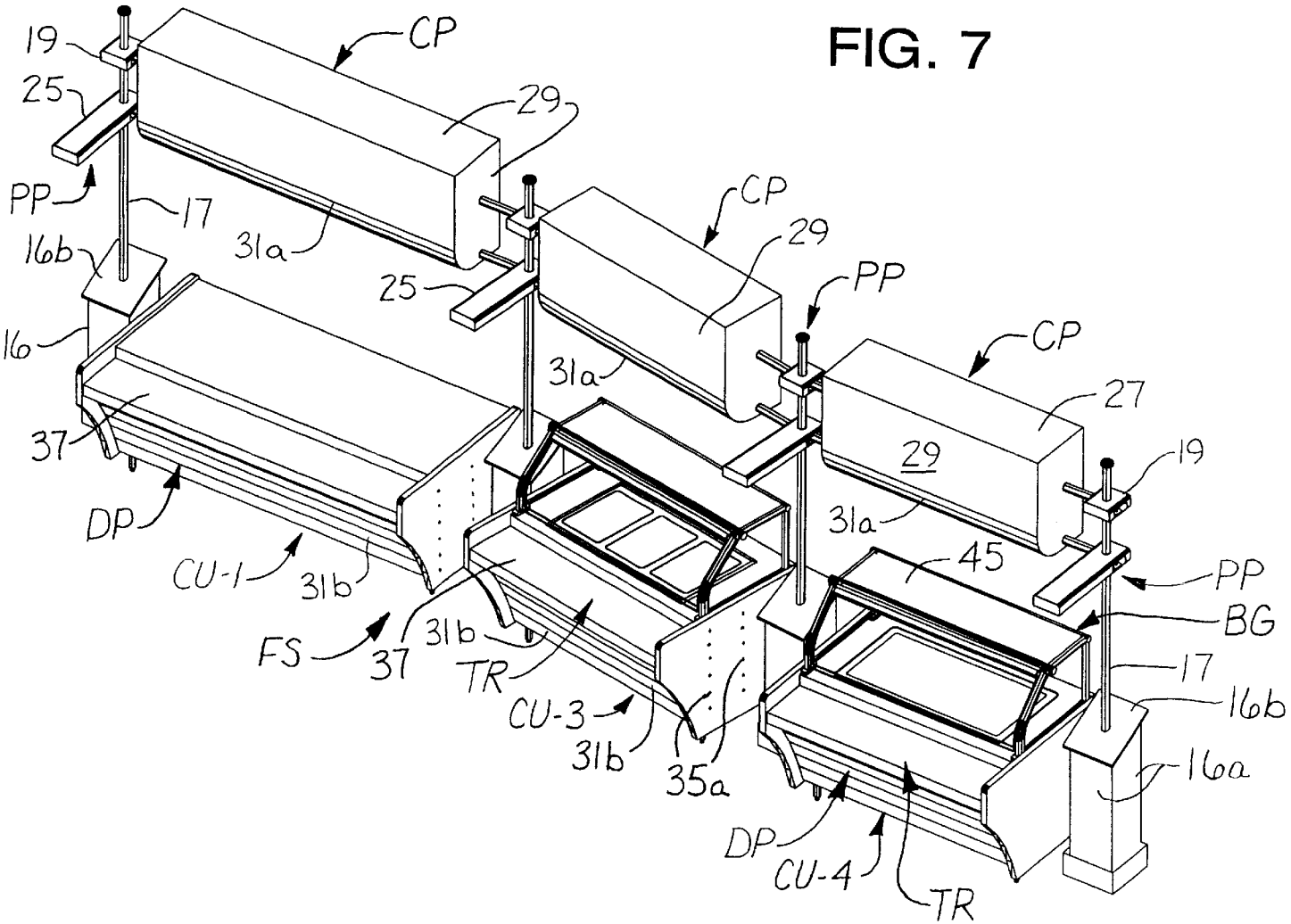
FIG. 7 is a front perspective similar to FIG. 5, but illustrating another multiple arrangement of the foodservice system.
Figure 8:
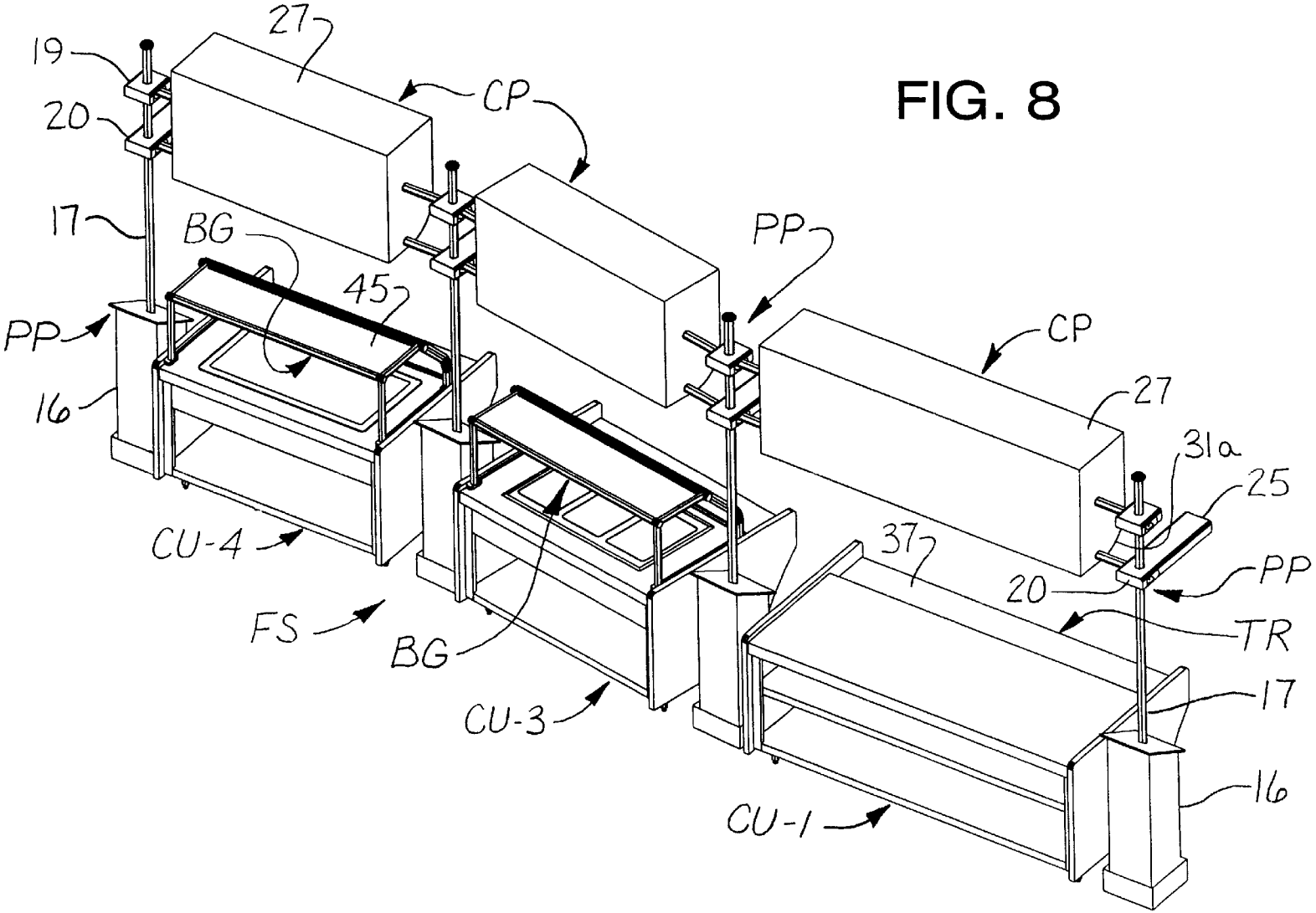
FIG. 8 is a rear view of the FIG. 7 arrangement.
Figure 9:
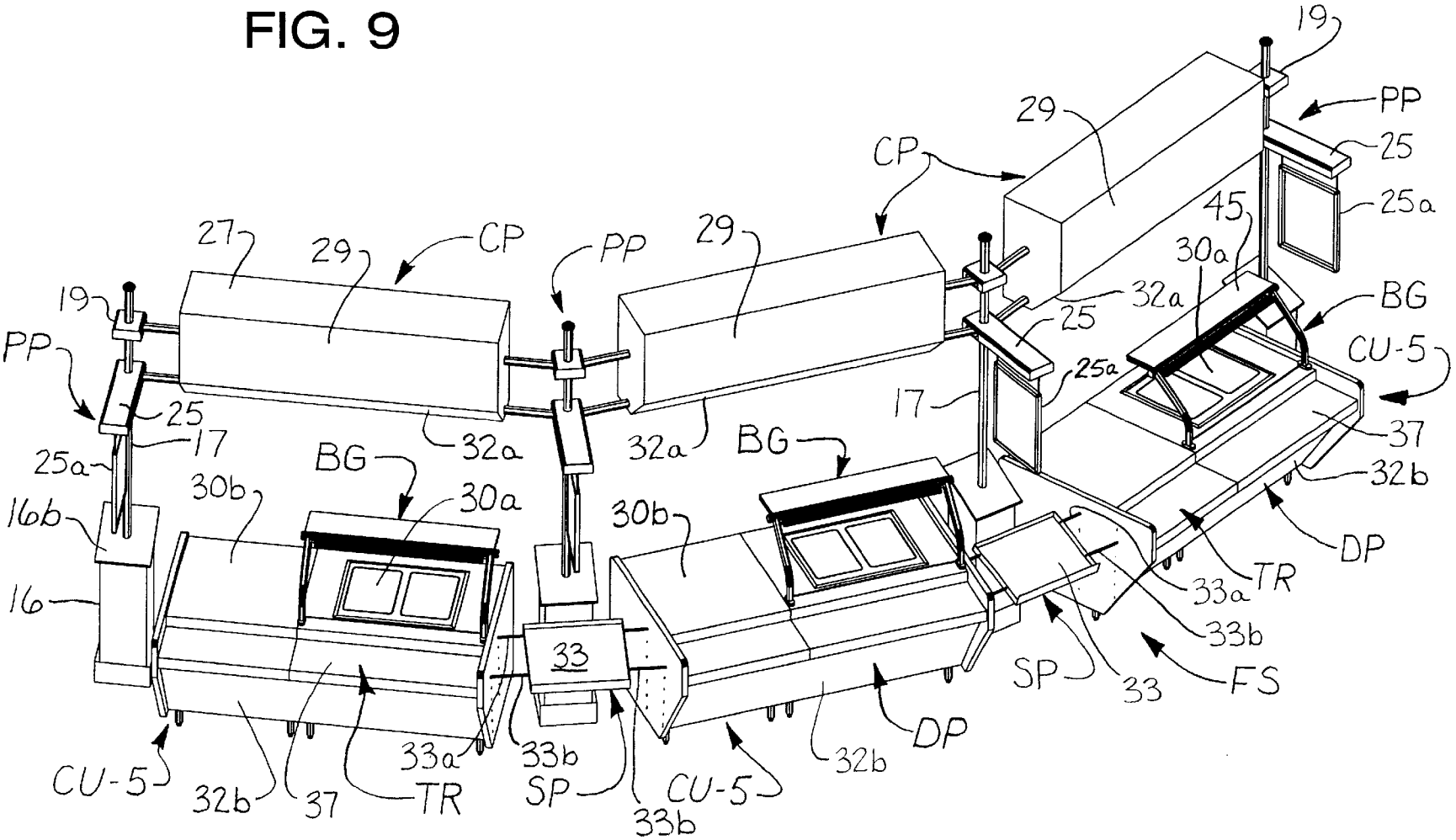
FIG. 9 is a front perspective similar to FIG. 5 showing a third multiple arrangement of foodservice system units.
Figure 10:
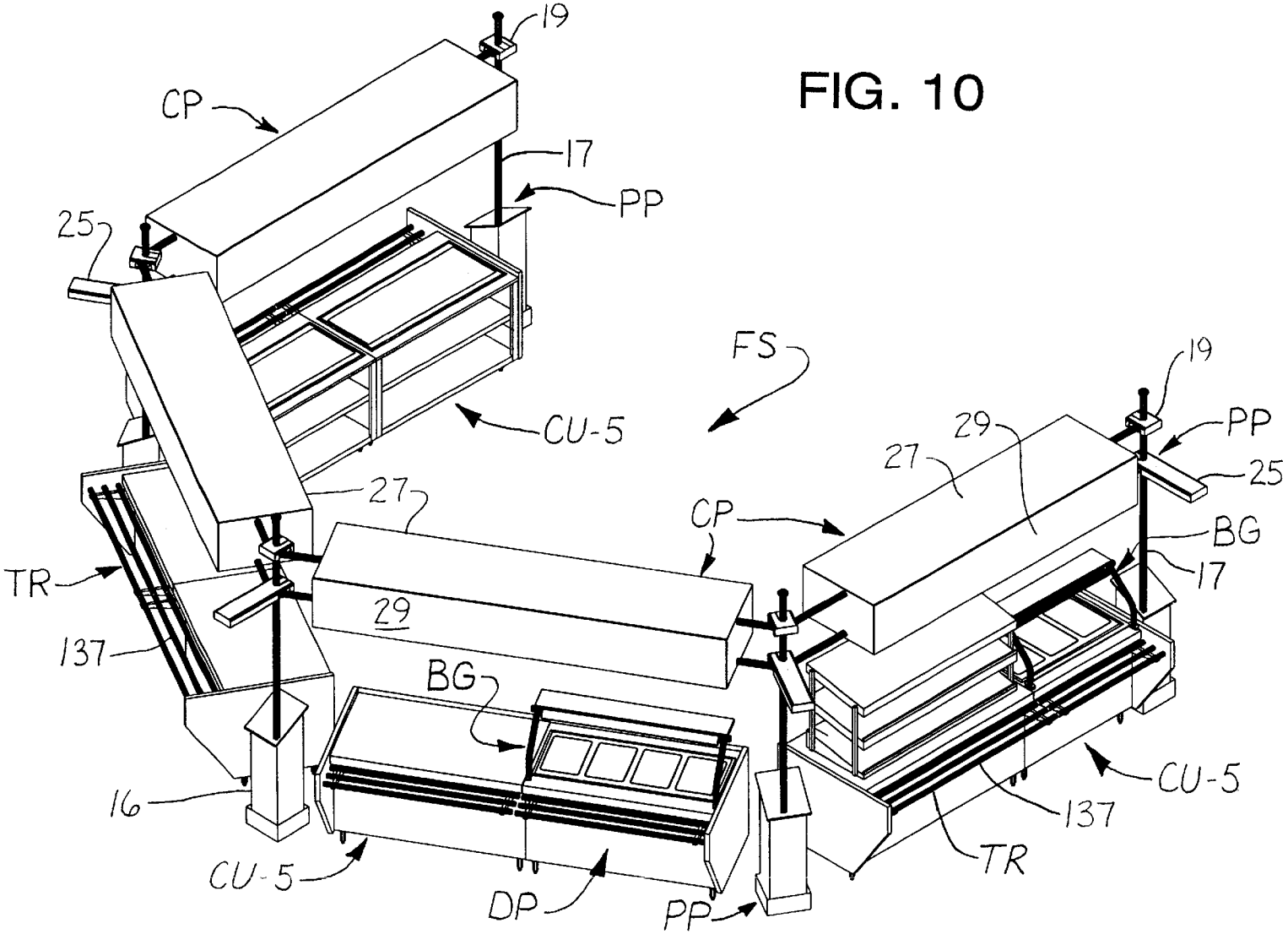
FIG. 10 is another front perspective showing a fourth multiple unit arrangement.

From the foregoing, and with reference to FIGS. 5–10, it is seen that a pylon peripheral PP is positioned on both sides of each counter unit CU so that in multiple counter arrangements there is a continuing decor effect created by the intermediate pylon peripherals as well as a continuity in the effect of the series of canopies. Thus, the novel peripheral decor system of the present foodservice system FS is found in single foodservice units (FIG. 11) and in multiple foodservice line-ups (FIGS. 5–10). It will also be seen that the invention provides flexibility in arranging multiple counter systems with the peripherals at various degrees of angularity accommodated by the hinging connections between the pylon peripherals PP and the canopy peripheral CP FIGS. 5 and 6 are front and rear facing views of a three counter arrangement sequentially showing a solid countertop counter CU-1, a hot food drop-in counter (i.e. steam table) CU-3 and a cold pan or frost top counter CU-2. In this embodiment the three units are arranged in a gentle arc, whereas in FIG. 10 a four unit system is arranged in a tighter curve. One of the decor features is the matching panel effect between the canopy peripheral CP and the decor panel DP of the counter front. Thus, the canopy of FIGS. 5, 6 (and also FIGS. 1–4 and 10) is squared off with a vertical front panel and the decor front DP of the counter is also matched as a vertical panel below the tray rail TR. FIGS. 7 and 8 show another multiple counter system FS which again has a similar arrangement of counters performing different foodservice functions; i.e. solid countertop CU-1, hot food drop-in CU-3 and a cold top drop-in CU-4. However, the canopy CP of FIGS. 7, 8 has a curved or rounded lower front section 31*a* which corresponds to a reversely curving decor panel 31*b* (at DP) on the counter. FIG. 9 shows a system arrangement of three counters CU-5 each of which has a two-well hot food drop-in side 30*a* and a solid top service side 30*b*. The decor feature of the canopy peripheral CP and counter decor panel DP in FIG. 9 shows that the lower front of the canopy is beveled or angle cut, at 32*a*, and the counter front wall DP is angularly formed, at 32*b*, from a vertical plane to complement this decor presentation. FIG. 10 further illustrates a foodservice system in which double counter units may be strategically arranged with the peripheral decor system.

Referring to FIGS. 9, 11, 14–14B, 15 and 16, the peripheral decor system of the invention further includes transitional shelving peripherals SP, which are artfully arranged in front of the pylon base section between adjacent counter units CU in a multiple line-up. In the preferred embodiment, a shelf 33 is provided with a pair of captured mounting arms 33*a*, 33*b* in mounting brackets 33*c* on the underside 33*d*. FIG. 9 shows one such shelf 33, and FIG. 11 shows two vertically spaced shelves 33 in substantially parallel disposition. The brackets 33*c* have side flanges 33*e* which accommodate the shorter arms 33*a* in relatively fixed relationship through opposed holes 33*f*. The arms 33*b* may be telescopically extendable and/or movably mounted in bracket slots 33*g* to permit angular as well as extended positioning of these arms 33*b*. The ends of the mounting arms or rods 33 have balls 34 for attachment to the counter units CU. As a modification to the extensible rods 33*b*, the rods 33*a* and 33*b* may all be the same length but the rods 33*b* are positioned at the rear of the shelves 33 to permit them to slide inwardly and angularly through the slots 33*g* to become the "shorter" rods when mounted on angularly arranged adjacent counter units CU.

Figure 14:
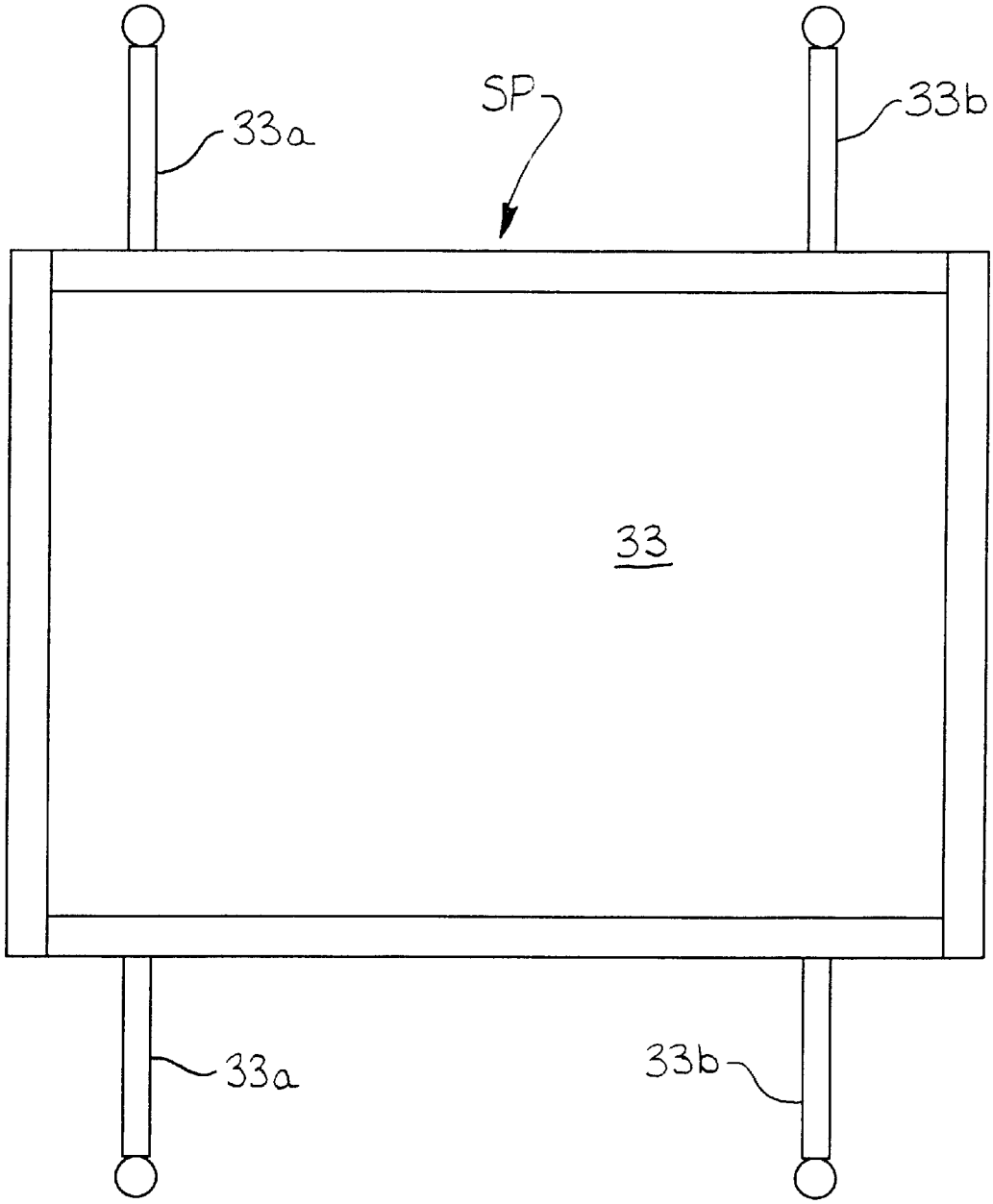
FIG. 14 is an enlarged top plan view of a transitional shelving peripheral for bridging between adjacent service counters with a pylon peripheral.
Figure 14C:
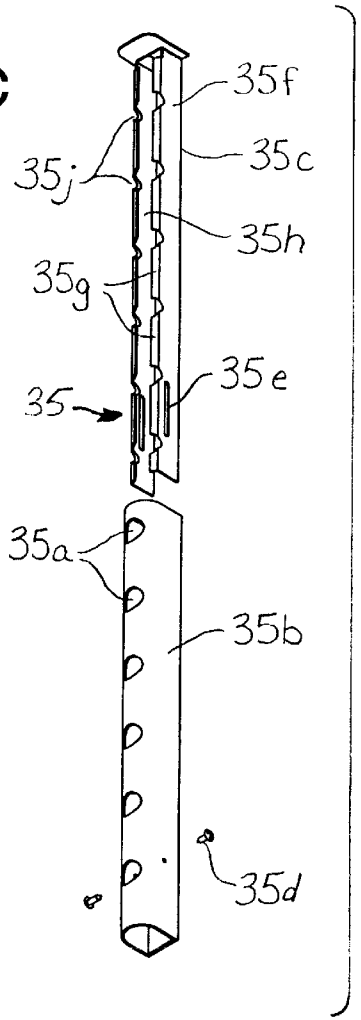
FIG. 14C is an exploded perspective view showing a mounting bracket for attachment of transitional shelving peripherals.
Figure 14A:
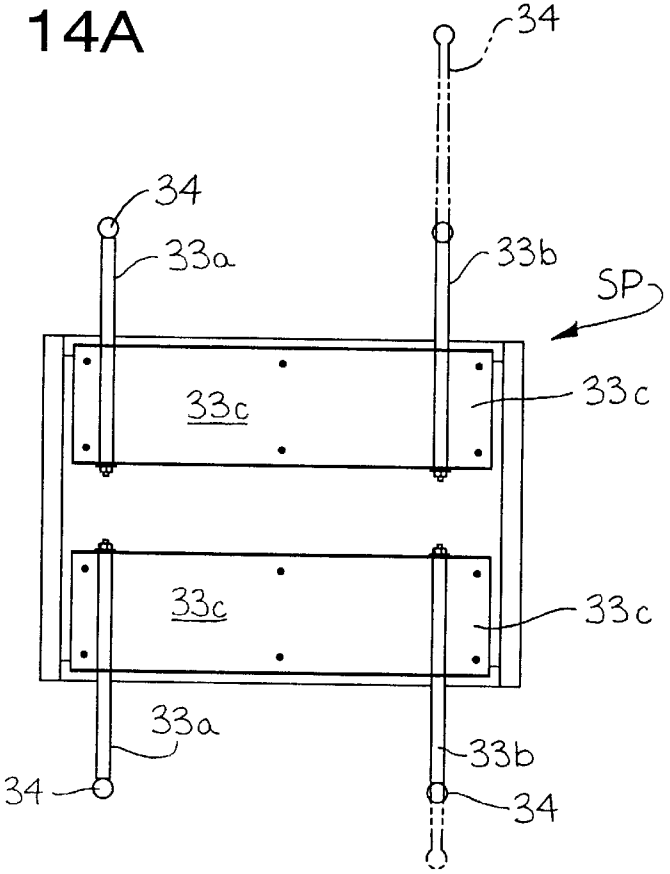
FIG. 14A is a rear elevational view of the transitional shelving peripheral of FIG. 14.
Figure 14B:
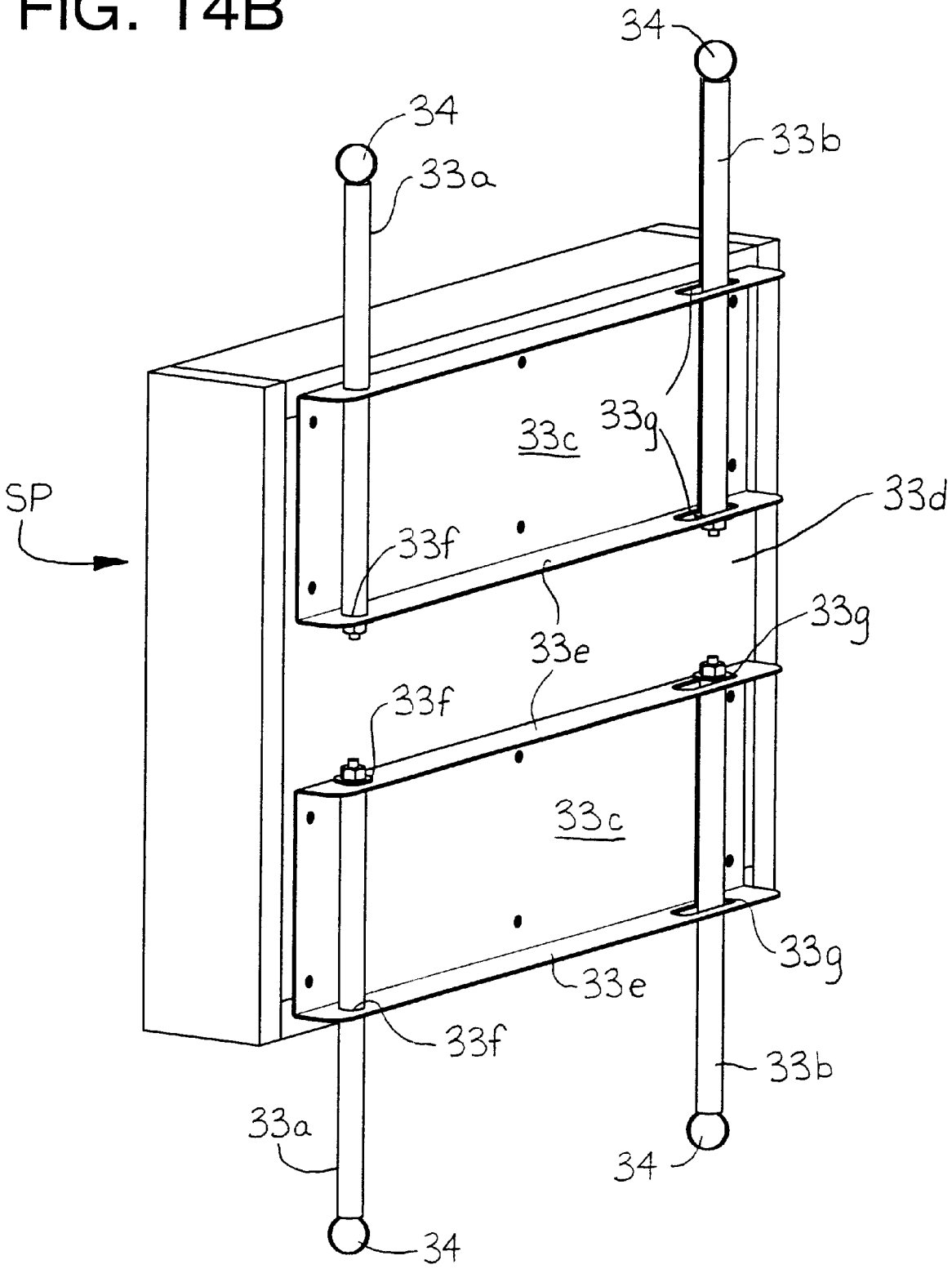
FIG. 14B is another rear elevation showing a modified shelving peripheral and adjustable mounting means therefor.
Figure 15:
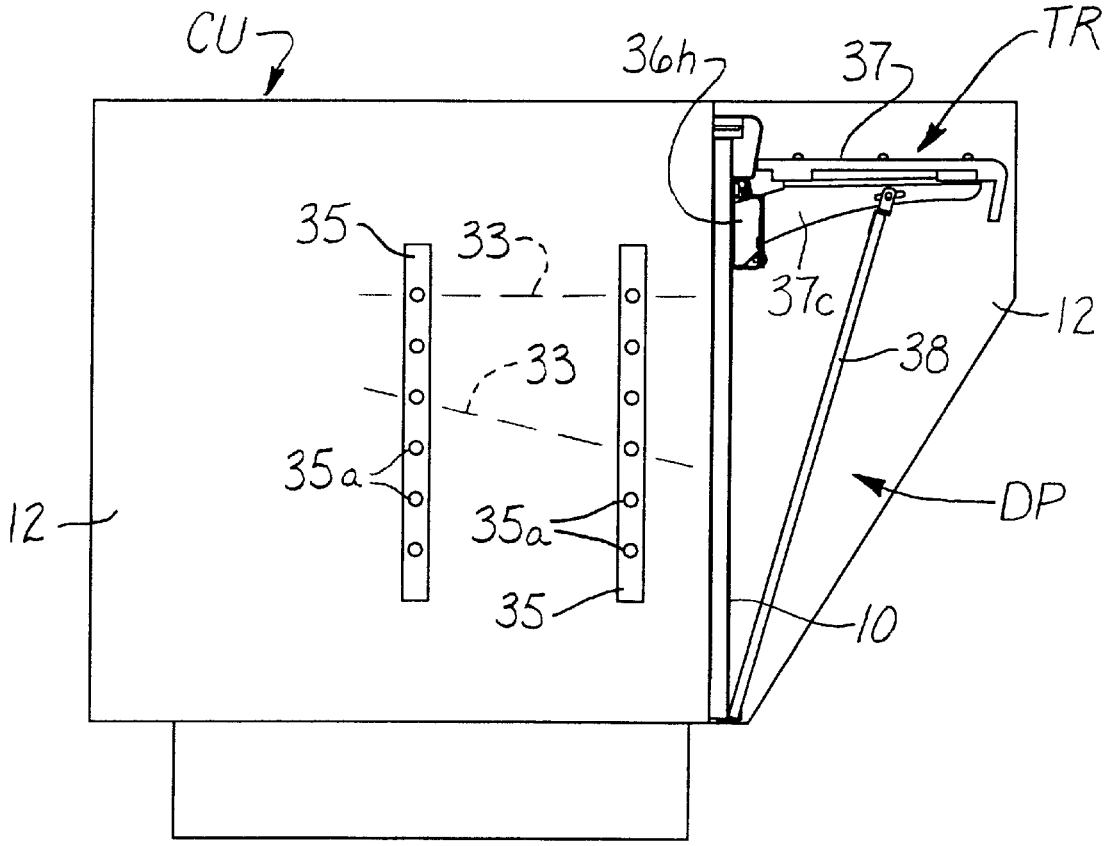
FIG. 15 is an end elevation, partly broken away, showing a service counter unit having one form of an improved tray rail.
Figure 16:
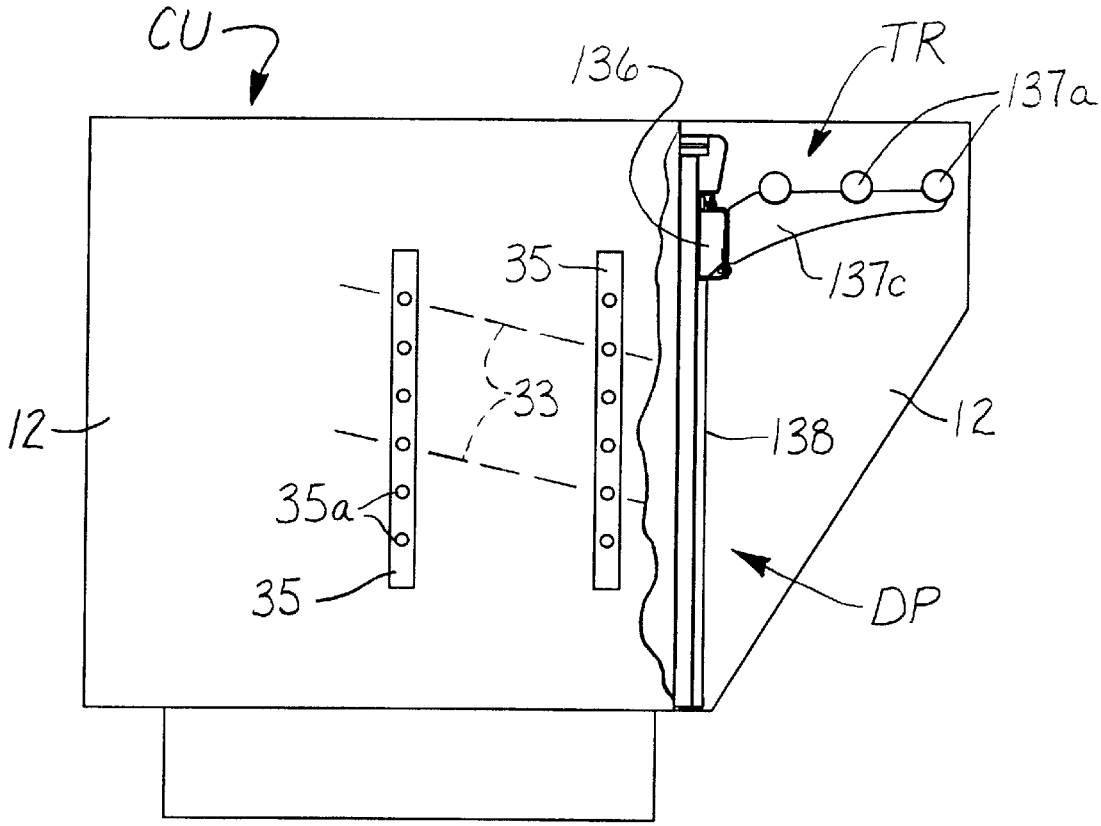
FIG. 16 is a view similar to FIG. 15 showing another tray rail embodiment.

FIGS. 14C, 15 and 16 best show the receiving brackets 35 for selectively positioning the mounting rods 33. A pair of the brackets 35 are vertically mounted on the opposed spaced end panels 12 of selected counter units CU to be spanned by the transitional shelving SP and in position to match the spacing between the mounting rods 33*a,* 33*b* of the shelf 33. Each bracket 35 has a series of vertically spaced holes 35*a* sized to receive the balls 34 on the rods 33*a,* 33*b*. As shown in FIGS. 15, 16, two shelves 33 are shown in broken lines to illustrate that the shelves can be positioned horizontally or that a shelf may be angularly pitched downwardly (or upwardly) if desired. FIG. 14 shows that the receiving bracket 35 includes the outer bracket shell or casing 35*b* which has the holes 35*a*. An inner slide latching member or keeper 35*c* is retained in the outer bracket shell by a pair of opposed guide pins 35*d* threaded in the casing wall and relatively slidably set in elongated slots 35*e* in opposed side walls 35*f* of the keeper 35*c*. The side walls 35*f* have a series of spaced flanges 35*g* defining an open vertical channel 35*h* that aligns with the holes 35*a* in the outer casing 35*b*, and the enlarged notches 35*j* along the side flanges 35*g* are sized to receive the shelving balls 34 on rods 33*a,* 33*b* when the inner keeper member 35*c* is in an upwardly opened or extended position. When the shelving SP is thus assembled on the counter brackets 35, the keeper 35*c* is pushed downwardly to position the balls in the channel 35*h* behind the flanges 35*g* to lock the shelving securely in place. The transitional shelving peripheral SP shown in FIGS. 9 and 11 is angularly pitched. Referring again to FIG. 12D, it will be seen that a modified transitional shelf peripheral SP having shelves 133 can be freely supported by the pylon peripheral PP independently of the adjacent counter unit CU.

Figure 15A:
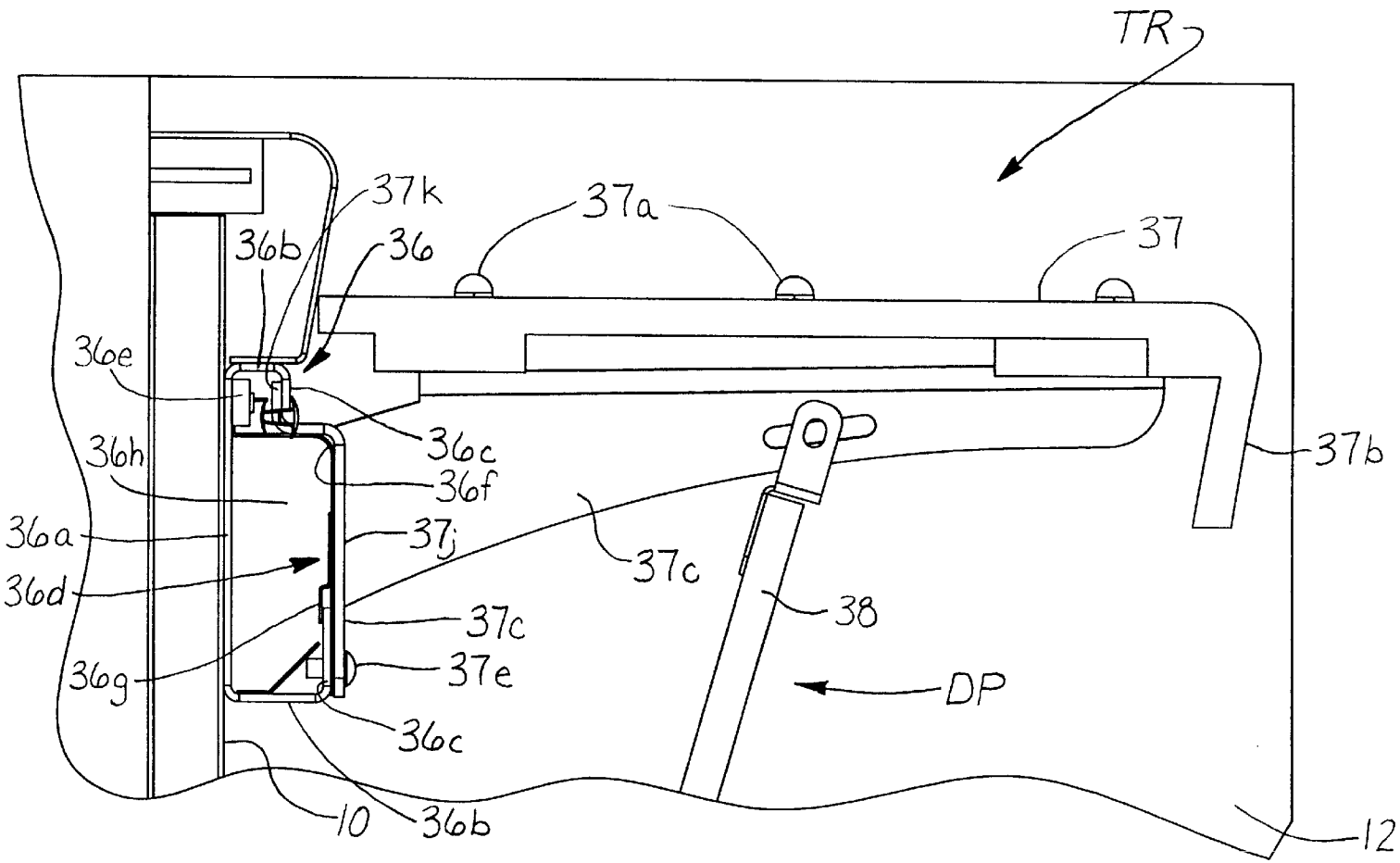
FIG. 15A is an enlarged fragmentary view showing construction and mounting details of the FIG. 15 embodiment.
Figure 16A:
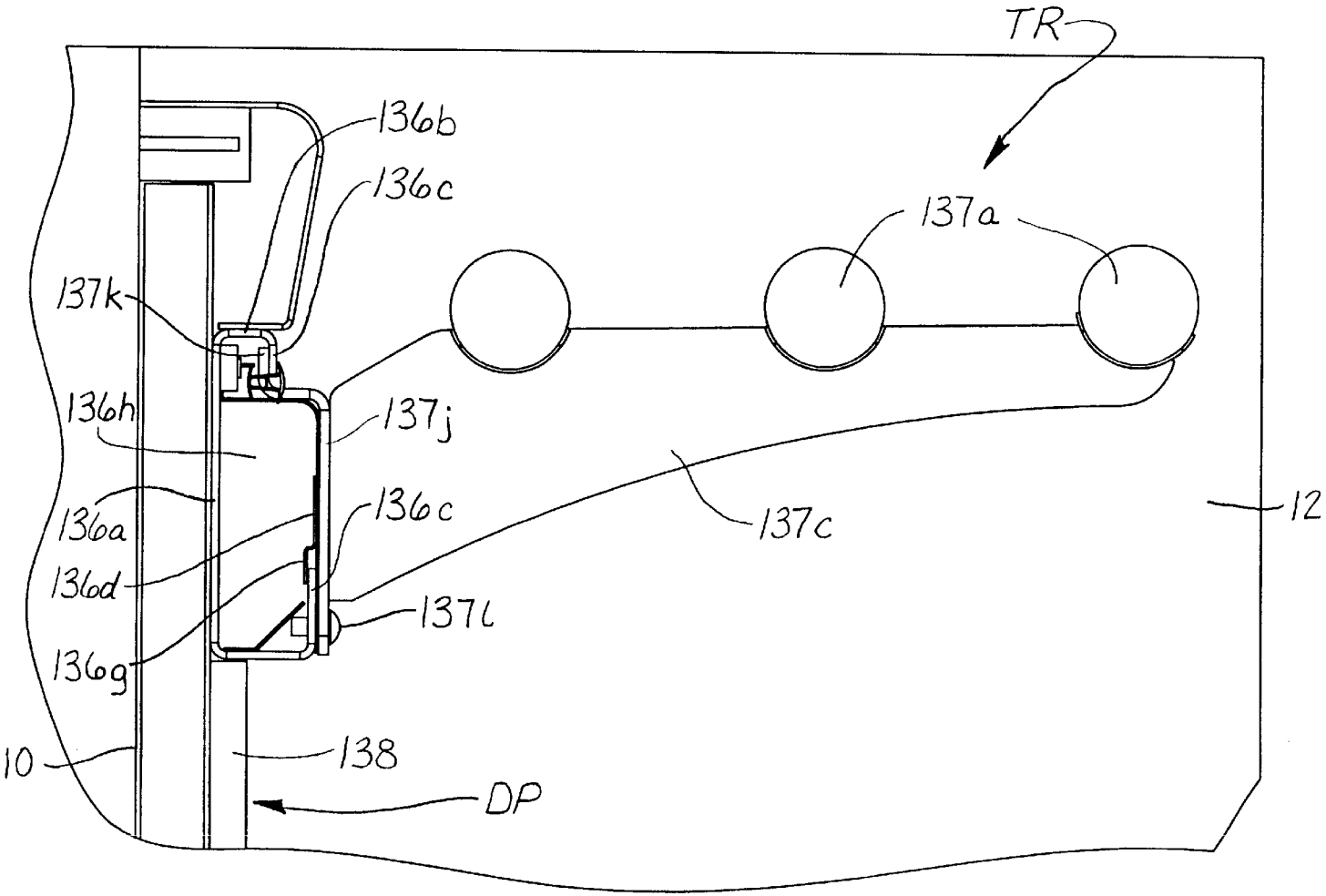
FIG. 16A is a view similar to FIG. 15A showing the FIG. 16 embodiment.

Still another feature of the foodservice system FS is the provision for tray rails TR constructed and arranged to accommodate the decor panel DP and also establish electric conduit chaseways. FIGS. 15, 15*a* shown one tray rail TR having solid upper surface 37 with raised spaced glide rails 37*a* and a down-turned front lip 37*b*. This tray rail TR is mounted on spaced brackets 37*c* attached to the counter cabinet 10 by an electrical chaseway and mounting assembly 36, and the brackets also accommodate the mounting of the panel 38 of the decor peripheral at an angle as in the FIG. 9 showing. The electric chaseway and mounting assembly 36 has a generally C-shaped mounting base 36*a* attached to the cabinet housing 10 and the out-turned walls 36*b* form into keeper flanges 36*c* on the free ends. An outer chase closing wall member 36*d* has a base attaching flange 36*e* with an outward and downward inverted L-shaped wall 36*f* that is bifurcated at its lower end 36*g* to receive the lower. flange 36*c* of the base member 36*a* thereby forming a closed chaseway 36*h* to accommodate electric conduits (not shown) or the like. The shelf flanges 37*c* are mounted perpendicular to vertical mounting plates 37; having an upper hooked latching lip 37*k* received under the upper end flange 36*c* of the base mounting bracket 36*a*. The lower margin of the plates 37; are secured to the base bracket 36*a* by bolts 37*e*. FIGS. 16, 16A show another tray rail 137 in which parallel tubular glide rails 137*a* are attached to mounting brackets 137*c*. The brackets 137*a* are attached to an electrical chaseway and mounting assembly 136 which accommodate mounting the panel 138 and which is similar to the structure just described with reference to FIG. 15A. It will be clear that the tray rail feature coordinates decor enhancement with functionality by combining the chaseway structure as a support for the decor panel DP.

Figure 17:
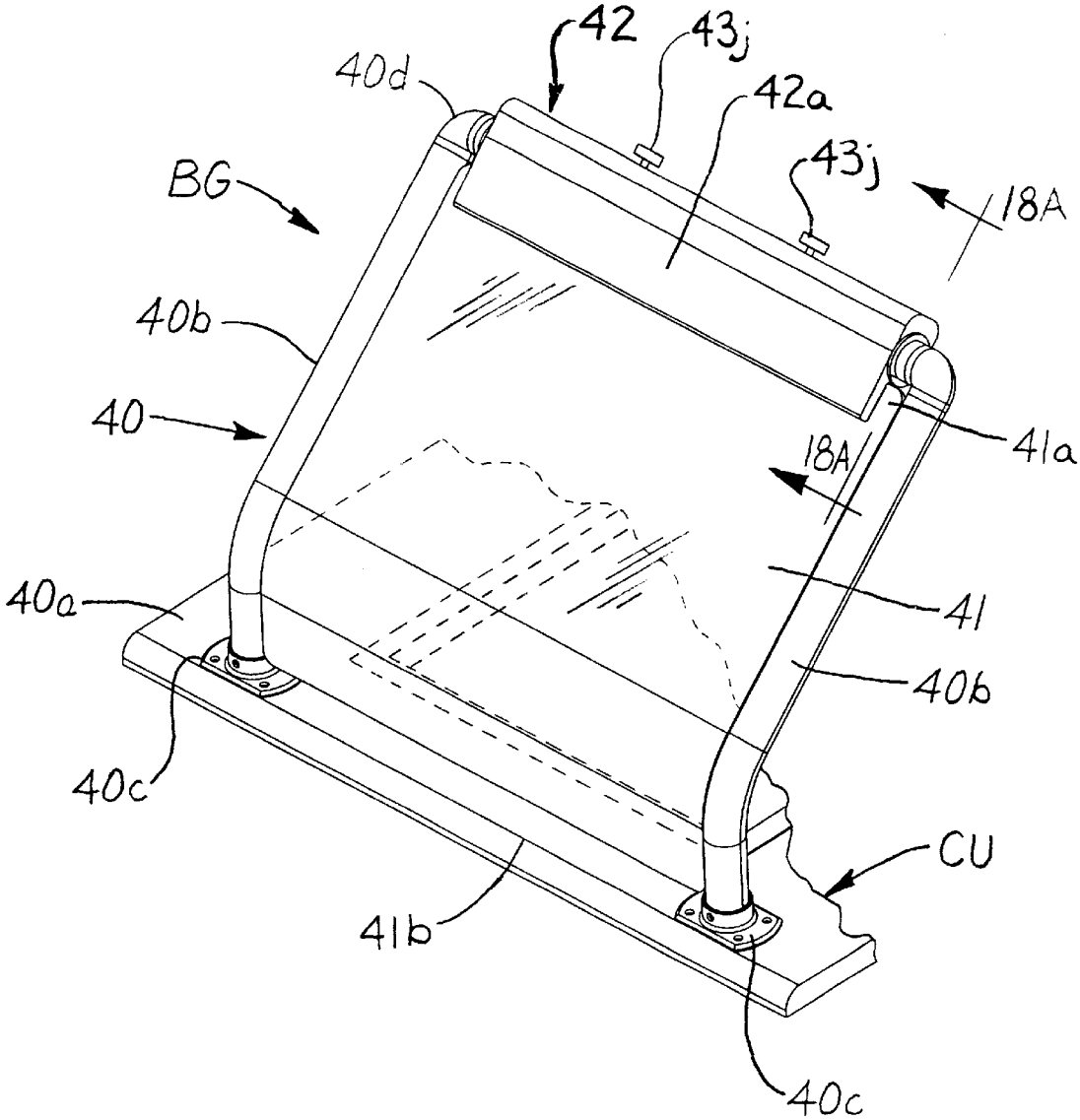
FIG. 17 is an enlarged perspective view showing a breath guard embodying one aspect of the present foodservice system invention.
Figure 17A:
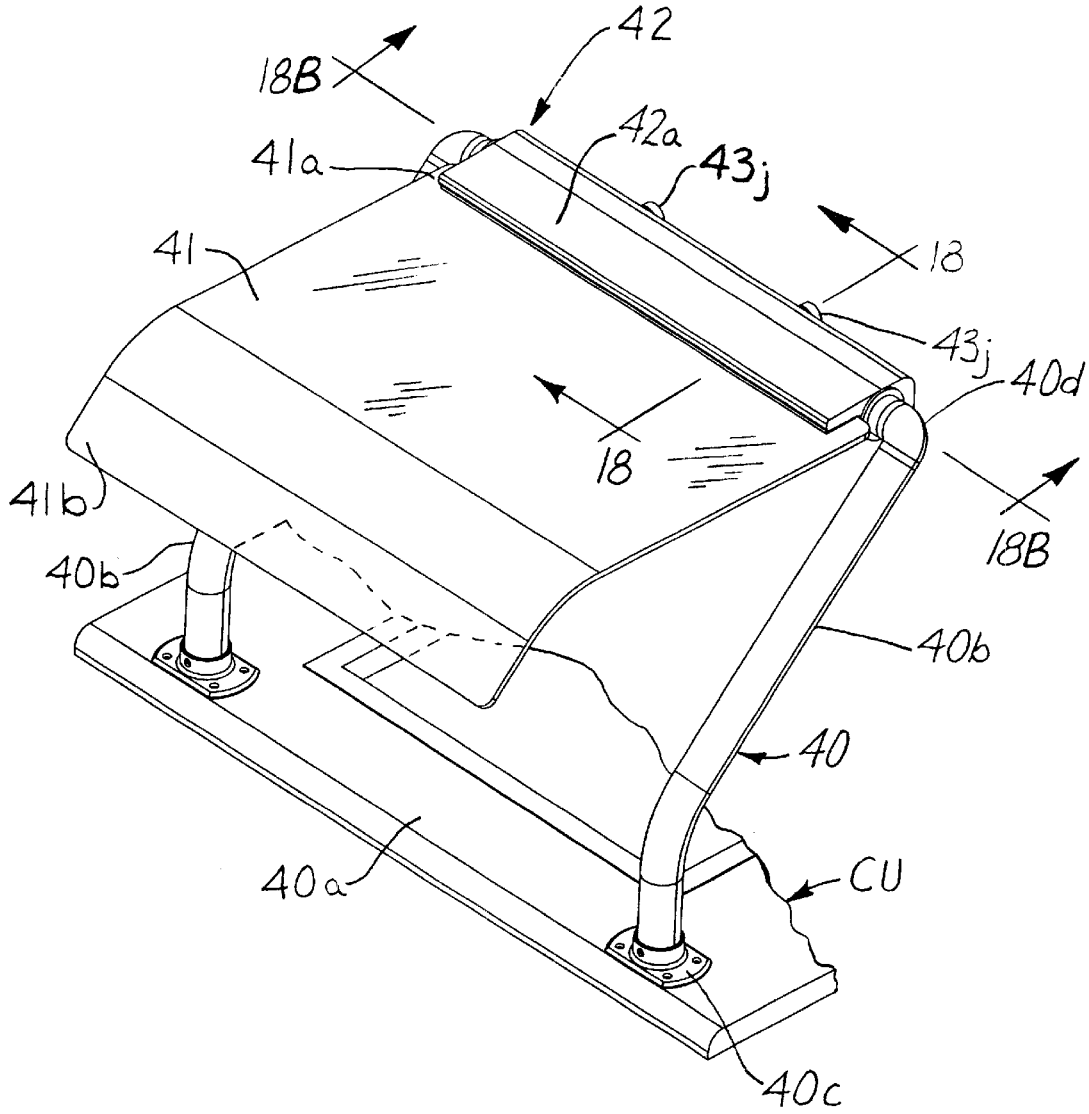
FIGS. 17A and 17B are fragmentary perspective views showing the angular adjustment positions of the breath guard of the inventions.
Figure 17B:
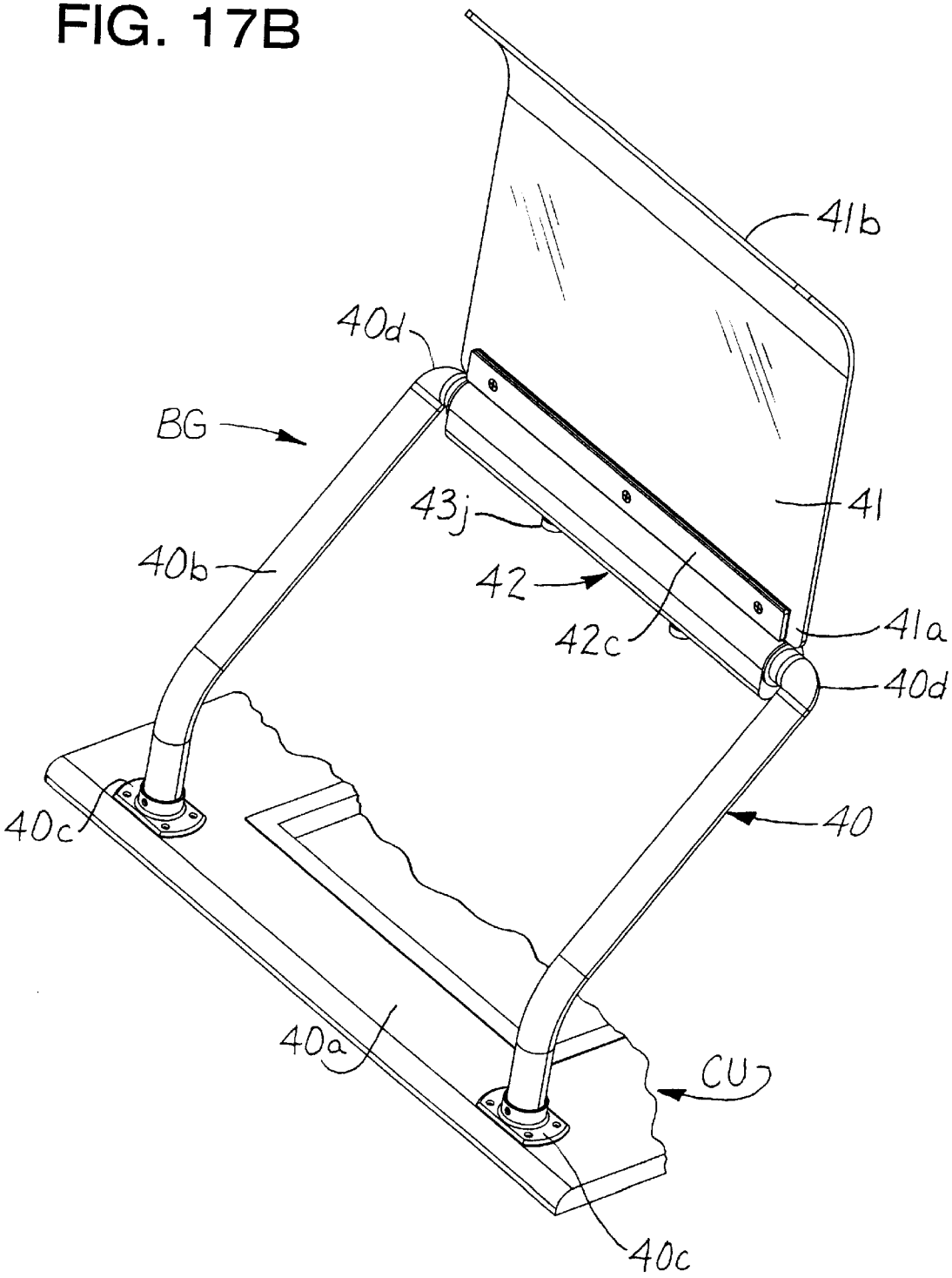

Another feature of the invention is a novel and decorative breath guard BG that also enhances the decor features of the peripheral decor system while guarding health and improving selective product accessibility and facilitating cleaning. FIGS. 17 and 17A, 17B show the three angular positions of the breath guard BG relative to its main mounting frame 40 and the countertop (40*a*) of the counter unit CU. The breath guard BG has a curved glass curtain wall 41 having an upper end edge 41*a* secured in a pivotal frame member 42, and a lower or outer free end edge 41*b*. The main mounting frame 40 has side frame pieces 40*b* bolted by base plates 40*c* to the countertop 40*a*, and in-turned mounting elbows 40*d* with reduced diameter end sections 40*e* to support the pivotal frame member 42 on the main frame 40. The pivot frame 42 for the glass 41, FIGS. 17 and 18, preferably comprises a metal outer frame having a hub or turning section 43 and an extended glass clamping section 42*a*. In the clamping section 42*a,* a flat upper wall 42*b* is opposed by a clamping plate 42*c* with the upper clamping end 41*a* of the glass curtain 41 being centered and protected by resilient cushions 42*d* on each side.

Figure 18:
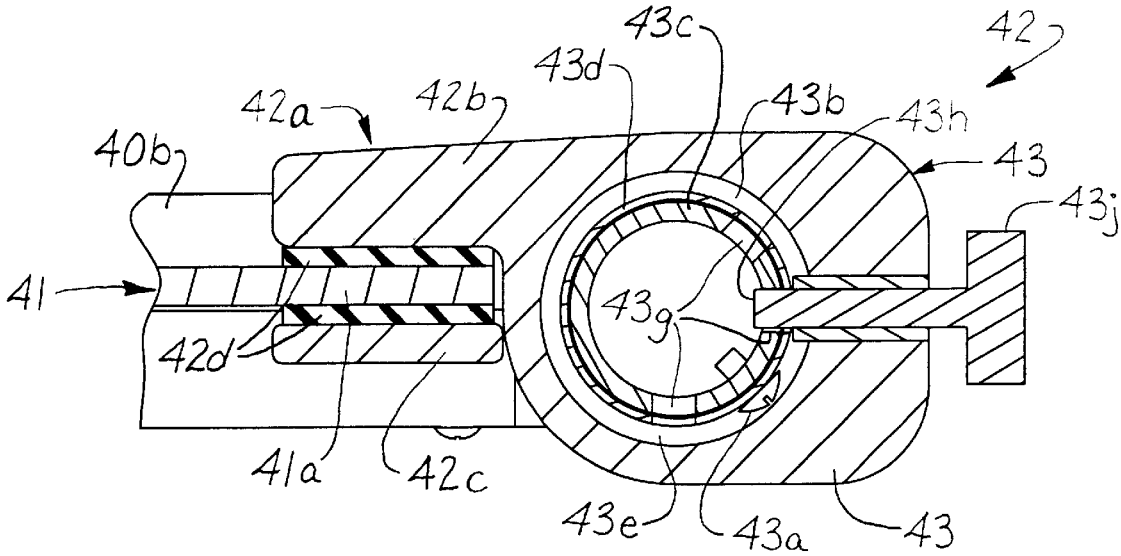
FIG. 18 is a greatly enlarged fragmentary sectional view taken along line 18—18 of FIG. 17A.
Figure 18A:
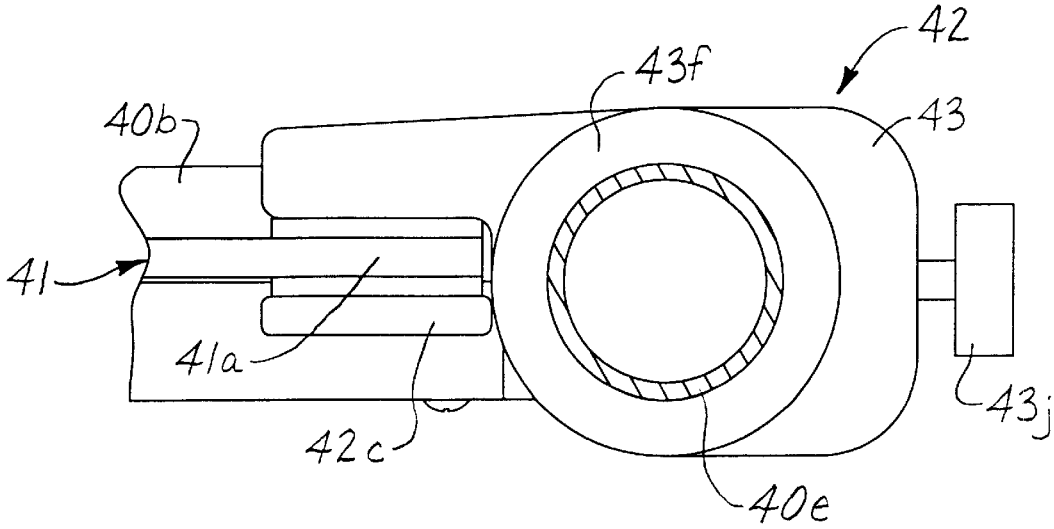
FIG. 18A is a similar view taken along line 18A—18A of FIG. 17.
Figure 18B:
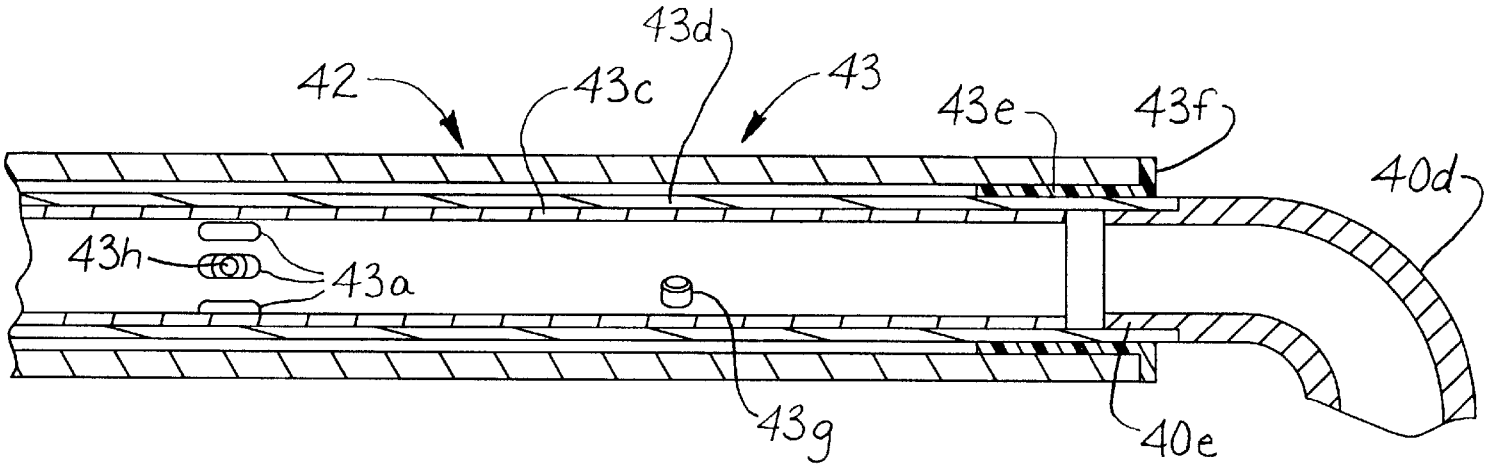
FIG. 18B is another enlarged sectional view taken along line 18B—18B of FIG. 17A.

The hub turning or pivot section 43 has an outer frame body 43*a* with a longitudinal bore 43*b* in which a pivot tube formed of concentric inner and outer cylinders 43*c* and 43*d* are centrally positioned by end bearing members 43*e* with flanges 43*f*. The inner and outer cylinders 43*c* and 43*d* of the pivot tube are secured together by bolts 43*g*. The elbows 40*d* of the mounting bracket 40 have the opposed in-turned ends 40*e* channeled into the extended end portions of the outer cylinder or tube 43*d* to hold the pivot tube in fixed position as part of the mounting frame 40, and the bearing 43*e* permits relative rotation of the pivot section 43 to move the curtain wall 41 on the pivot axis between the lower, intermediate and upper latched positions of the glass curtain. As seen in FIGS. 18 and 18B, the pivot tubes 43*c,* 43*d* are provided with longitudinally spaced sets of elongated slots 43*g*, and spring loaded latch pins 43*h* are 30 mounted in the outer body wall 43 of the pivot section 43 to extend selectively into one of the slot positions—the latch pin 43*h* being manipulated by a pull-out handle 43*j*. Referring to FIG. 11, a dual breath guard BG is shown with an intermediate side frame member that supports the two separate pivot section frames by a T-joint 40*g* similar to te end elbows 40*d*. Also, as seen in FIGS. 7–10, the counter unit may have a service shelf 45 supported to extend rearwardly from the breath guard for placing food items or plates when the breath guard is in its closed position. The shelf 45 may be a directly heated surface or have heat lamps (not shown) strategically mounted on the canopy peripheral thereabove. It will thus be apparent that the breath guard BG of the invention permits selective positioning of the glass curtain wall 41 to lower closed and upper fully open positions with an intermediate self-service position. I Clearly, additional intermediate positions may be provided.

From the foregoing it will be apparent that a foodservice system incorporating a novel decor peripheral system and other unique features has been disclosed to meet the objectives and advantages set forth. The invention covers changes and modifications to the disclosure that will be apparent to those skilled in the foodservice art, and the invention is only to be limited by the scope of the appended claims.

What is claimed is:

1. A foodservice system comprising, in combination, a primary counter unit constructed and arranged for performing a foodservice function and including countertop and front service sections, an independent first peripheral unit positioned in juxtaposition with said counter unit for performing a non-foodservice function, the first peripheral unit comprising a free-standing pylon means laterally disposed relative to said counter unit and being constructed and arranged for supporting other peripheral means at a vertical level above said counter means.

2. The foodservice system of claim 1, in which said other means comprises a decor display means.

3. The foodservice system of claim 2, in which said decor display means is a separate canopy peripheral unit mounted in superjacent disposition over the counter unit.

4. The foodservice system of claim 2, in which said decor display means is a banner.

5. The foodservice system of claim 1, in which said pylon peripheral has a floor-supported base and a vertically disposed stanchion member, and said other peripheral means comprises a support arm mounted on said stanchion member.

6. The foodservice system of claim 1, in which the other peripheral unit performs a non-foodservice function selected from a class consisting of lighting, storage, decor display, advertising and information signage.

7. The foodservice system of claim 1, in which the peripheral unit comprises transitional shelving means constructed and arranged for lateral disposition relative to said counter unit and being selectively adapted for either foodservice or non-foodservice functions.

8. The foodservice system of claim 1, in which said front service section comprises a tray rail for supporting a food tray during the dispensing of direct food service.

9. The foodservice system of claim 7, in which said primary counter unit further comprises a front decor panel disposed below the tray rail.

10. A foodservice system comprising, in combination, a primary counter unit constructed and arranged for performing a foodservice function, and at least one independent peripheral unit constructed and arranged in juxtaposition with said counter unit for performing a non-foodservice function, said primary counter unit comprising a countertop section adapted for the foodservice function thereof and a front service section for dispensing direct food service from the countertop section, and electrical service means for housing electrical connectors for the counter unit, said electrical service means being located below the front service section at the front of said counter unit.

11. The foodservice system of claim 10, in which electrical service means comprise a chaseway having inner and outer brackets with spaced wall sections defining the chaseway.

12. The foodservice system of claim 11, in which said front service section includes a tray rail for supporting a service tray, and means for attaching said tray rail to the outer chaseway brackets.

13. The foodservice system of claim 11, including a front decor panel attached to the chaseway.

14. The foodservice system of claim 10, including breath guard means for shielding the countertop section from the front service section, said breath guard means comprising a transparent panel mounted at the front service section and being constructed and arranged for movement between a latched lowered closed position and a latched raised open position.

15. The foodservice system of claim 14, in which said breath guard also has an intermediate latching position between the lower and upper positions.

16. The foodservice system of claim 14, in which said breath guard is of predetermined length to be mounted for selectively shielding a service section of the counter unit.

17. A foodservice system comprising, in combination, a first counter unit constructed and arranged for performing a foodservice function, a second counter unit arranged at one end of said first counter unit and being in spaced relation therewith, and at least one independent peripheral unit constructed and arranged in juxtaposition with said counter units for performing a non-foodservice function, said peripheral unit being strategically placed between the adjacent ends of said first and second counter units and being a transitional shelf peripheral having opposed pairs of mounting rods extending from a display shelf, and mounting means on each of said counter unit ends for receiving the mounting rods.

18. The foodservice system of claim 17, in which said mounting means is constructed and arranged with locking means for securing the mounting rods thereto.

19. The foodservice system of claim 17, in which said mounting means is constructed and arranged for accommodating relative angular positioning of the shelving peripheral.

20. The foodservice system of claim 19, in which said mounting rods have balls on the outer ends, and said mounting means has a vertically disposed series of holes to selectively receive the mounting rod balls therein.

21. A peripheral decor system for a foodservice counter unit having countertop means for performing a foodservice function and a front service area, the decor system comprising a first peripheral unit constructed and arranged for independent lateral disposition relative to the front service area of the counter unit, and a second peripheral unit constructed and arranged for independent disposition relative to the countertop means of the counter unit, said first peripheral unit being a free-standing pylon having an upper section positioned at a vertical level above the countertop means of the counter unit and including mounting means for supporting the second peripheral unit vertically above the counter unit.

22. The decor system of claim 21, in which said second peripheral unit includes a transitional shelf constructed to extend substantially parallel to the plane of the front service area of the counter unit.

23. The decor system of claim 21, in which the second peripheral unit performs a non-foodservice function selected from a class that includes lighting, storage, decor display, advertising and information signage.

24. A peripheral decor system for a foodservice counter unit having countertop means for performing a foodservice function and a front service area, the decor system comprising a pair of first pylon peripheral units for spaced placement at each end of the counter unit and being constructed and arranged for independent lateral disposition relative to the front service area thereof, a second canopy peripheral unit constructed and arranged for independent disposition relative to the countertop means of the counter unit extending vertically above the countertop means of the counter unit and including mounting means for mounting the second canopy peripheral unit vertically above the counter unit whereby said canopy forms a bridging span therebetween.

25. The decor system of claim 24, in which said second peripheral unit includes at least one transitional shelf mounted on said pylon adjacent to the front service area of said counter unit.

26. The decor system of claim 24, in which said canopy peripheral is angularly movable relative to said pylon-peripheral units.

27. A foodservice system comprising, in combination, a primary counter unit constructed and arranged for performing a direct foodservice function, a first peripheral unit constructed and arranged in independent juxtaposition with said counter unit for performing a non-foodservice function, said first peripheral unit comprising a free-standing pylon laterally disposed from the counter unit and including decor display means, a second peripheral unit mounted on said pylon independently of said counter unit and being constructed and arranged for angular movement relative thereto.

28. The foodservice system of claim 27, which includes a second peripheral unit mounted on said pylon independently of said counter unit.

29. The foodservice system of claim 27, in which said second peripheral comprises at least one transitional shelf.

30. The foodservice system of claim 27, in which said second peripheral comprises a canopy supported by said pylon above said counter unit.

31. The foodservice system of claim 27, which includes a primary service counter unit and a secondary service counter unit arranged in side-by-side spaced relationship therewith, both of said counter units having direct foodservice functions, and a first pylon peripheral strategically arranged between said counter units and independent thereof, said first pylon peripheral extending vertically above said counter units, and at least one other peripheral mounted on said pylon peripheral.

32. The foodservice system of claim 31, in which said one other peripheral comprises a transitional shelf peripheral.

33. The foodservice system of claim 31, in which said one other peripheral comprises a canopy peripheral constructed and arranged for vertical positioning above one of the primary and secondary units.

34. The foodservice system of claim 33, including a second pylon peripheral laterally disposed at the other end of the primary counter unit from said first pylon peripheral and being similar thereto in decor configuration, and said first and other pylon peripherals supporting said canopy peripheral and forming a decor peripheral system therewith.

* * * * *